US009750351B2

(12) United States Patent
Sack et al.

(10) Patent No.: US 9,750,351 B2
(45) Date of Patent: Sep. 5, 2017

(54) SEAT ASSEMBLY FOR AN INFANT CHAIR AND INFANT HIGH CHAIR INCLUDING THE SAME

(71) Applicant: Wonderland Nurserygoods Company Limited, Kwai Chung, N.T. (HK)

(72) Inventors: Daniel A. Sack, Pottstown, PA (US); Andrew J. Horst, West Lawn, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 143 days.

(21) Appl. No.: 14/797,244

(22) Filed: Jul. 13, 2015

(65) Prior Publication Data

US 2016/0007766 A1 Jan. 14, 2016

Related U.S. Application Data

(60) Provisional application No. 61/998,924, filed on Jul. 11, 2014.

(51) Int. Cl.

| | |
|---|---|
| ***A47D 1/00*** | (2006.01) |
| ***A47D 1/04*** | (2006.01) |
| ***A47D 1/02*** | (2006.01) |

(52) U.S. Cl.

CPC ..... *A47D 1/008* (2013.01); *A47D 1/02* (2013.01); *A47D 1/04* (2013.01)

(58) Field of Classification Search

CPC . A47D 1/00; A47D 1/02; A47D 1/004; A47D 1/008

See application file for complete search history.

(56) References Cited

U.S. PATENT DOCUMENTS 4,019,751 A * 4/1977 Nakao ..... A47D 1/002 280/31
9,554,658 B2 * 1/2017 Horst ..... A47D 1/02

(Continued)

FOREIGN PATENT DOCUMENTS

CN 201542160 U 8/2010
DE 20310316 U1 9/2003

(Continued)

OTHER PUBLICATIONS

Office Action of co-pending DE Patent Application No. 10 2015 106 785.4 dated Mar. 9, 2016.

(Continued)

*Primary Examiner* — Timothy J Brindley
(74) *Attorney, Agent, or Firm* — Baker & McKenzie LLP

(57) ABSTRACT

A seat assembly for infant chair includes a seat support frame, a rear and a front seat portion respectively connected with the seat support frame, and a weight-sensitive lock mechanism placed adjacent to the rear and front seat portions. The front seat portion is slidable relative to the rear seat portion along a lengthwise axis between an expanded state and a contracted state, the lengthwise axis extending from a front to a rear of the seat assembly, and the front and rear seat portion when in the expanded state defining a sitting surface adapted to receive a child. The weight-sensitive lock mechanism is activated by the placement of a load on the seat assembly to prevent displacement of the front seat portion relative to the rear seat portion from the expanded state to the contracted state. In one embodiment, the seat assembly including the weight-sensitive lock mechanism is implemented in an infant high chair.

24 Claims, 30 Drawing Sheets

(56) References Cited

U.S. PATENT DOCUMENTS

| | | | | |
|---|---|---|---|---|
| 2005/0242646 | A1* | 11/2005 | You | A47D 1/02 297/354.1 |
| 2007/0024095 | A1* | 2/2007 | Chen | A47D 1/002 297/16.1 |
| 2007/0194614 | A1 | 8/2007 | Chen et al. | |
| 2008/0179922 | A1* | 7/2008 | Troutman | A47D 1/002 297/135 |
| 2010/0320810 | A1 | 12/2010 | Chen | |
| 2014/0070574 | A1* | 3/2014 | Li | A47D 1/002 297/35 |
| 2015/0289674 | A1* | 10/2015 | Winterhalter | A47D 1/008 297/16.1 |
| 2016/0324330 | A1* | 11/2016 | Xu | A47D 1/002 |

FOREIGN PATENT DOCUMENTS

| | | | |
|---|---|---|---|
| EP | 3898813 | A2 | 3/1999 |
| EP | 2829199 | A1 | 1/2015 |
| GB | 2391801 | A | 2/2004 |
| GB | 2476896 | A | 7/2011 |
| JP | H09191967 | A | 7/1997 |
| WO | 2010114457 | A1 | 10/2010 |

OTHER PUBLICATIONS

Office Action dated Jun. 20, 2016 in co-pending UK Patent Application No. 1608963.3.

Combined Search and Examination Report from co-pending UK Patent Application No. 1507369.5.

Office Action of co-pending DE Patent Application No. 10 2015 106 785.4.

Office Action of co-pending UK Patent Application No. 1512081.9.

* cited by examiner

SEAT ASSEMBLY FOR AN INFANT CHAIR AND INFANT HIGH CHAIR INCLUDING THE SAME

CROSS-REFERENCE TO RELATED APPLICATION(S)

This application claims priority to U.S. Provisional Patent Application No. 61/998,924 filed on Jul. 11, 2014, the disclosure of which is incorporated herein by reference.

BACKGROUND

1. Field of the Invention

The present invention relates to seat assemblies and infant high chairs including the same.

2. Description of the Related Art

High chairs for infants and children typically include a rigid frame on which a seat is supported above the floor, and a tray attached to the seat. Conventional high chairs for infants usually have a large footprint and an oversized tray that may occupy substantial space in a kitchen or a room, which may make it difficult for a caregiver to organize the eating area in a room with limited space. Another drawback of certain existing high chairs is a relatively complex folding method: a caregiver often has to perform three or more steps, or separately operate several locking mechanisms in order to collapse the high chair for storage. Moreover, certain folded configuration of the high chair may not be sufficiently compact for convenient storage, which may discourage the caregiver to fold the high chair.

Therefore, there is a need for an improved high chair for infants that can have a more compact storage size and address at least the foregoing issues.

SUMMARY

The present application describes a seat assembly, and an infant high chair including the seat assembly. In one embodiment, the infant high chair includes a collapsible standing frame, a seat support frame connected with the standing frame, a rear and a front seat portion respectively connected with the seat support frame, and a weight-sensitive lock mechanism placed adjacent to the rear and front seat portions. The front seat portion is movable relative to the rear seat portion between an expanded state and a contracted state, the front and rear seat portion when in the expanded state defining a sitting surface adapted to receive a child. The weight-sensitive lock mechanism is activated by the placement of a load on the sitting surface to prevent displacement of the front seat portion relative to the rear seat portion from the expanded state to the contracted state.

According to another embodiment, the present application provides a seat assembly for an infant chair. The seat assembly includes a seat support frame, a rear and a front seat portion respectively connected with the seat support frame, and a weight-sensitive lock mechanism placed adjacent to the rear and front seat portions. The front seat portion is slidable relative to the rear seat portion along a lengthwise axis between an expanded state and a contracted state, the lengthwise axis extending from a front to a rear of the seat assembly, and the front and rear seat portion when in the expanded state defining a sitting surface adapted to receive a child. The weight-sensitive lock mechanism is activated by the placement of a load on the seat assembly to prevent displacement of the front seat portion relative to the rear seat portion from the expanded state to the contracted state.

Advantages of the structures described herein include the ability to provide a seat assembly that have a rear and a front seat portion adjustable between an expanded state and a contracted state, and further include a weight-sensitive lock mechanism that can prevent accidental collapsing operation. Accordingly, the seat assembly can be safer in use.

DETAILED DESCRIPTION OF THE EMBODIMENTS

Figure 1:
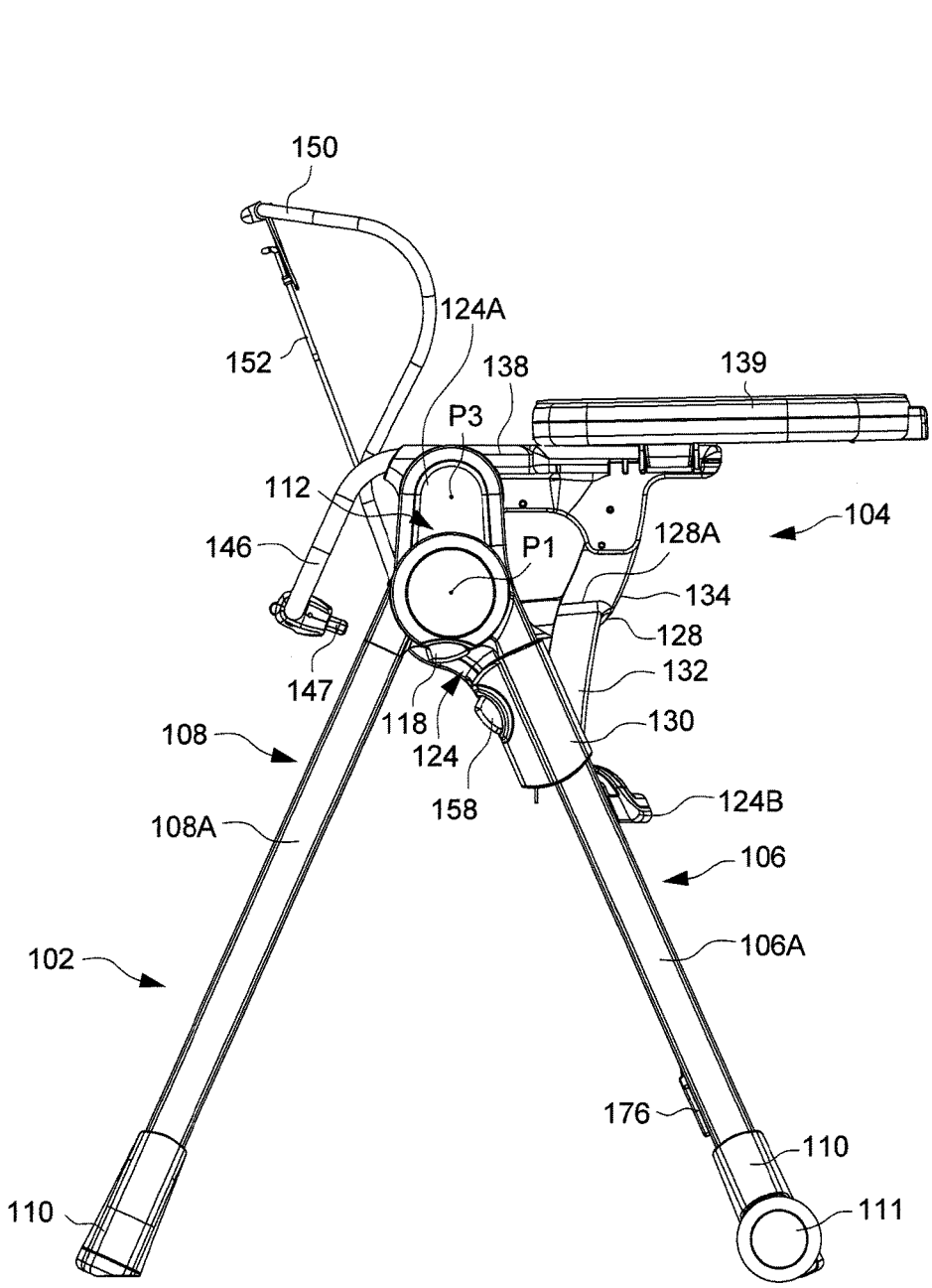
FIG. 1 is a side view illustrating an embodiment of an infant high chair.
Figure 2:
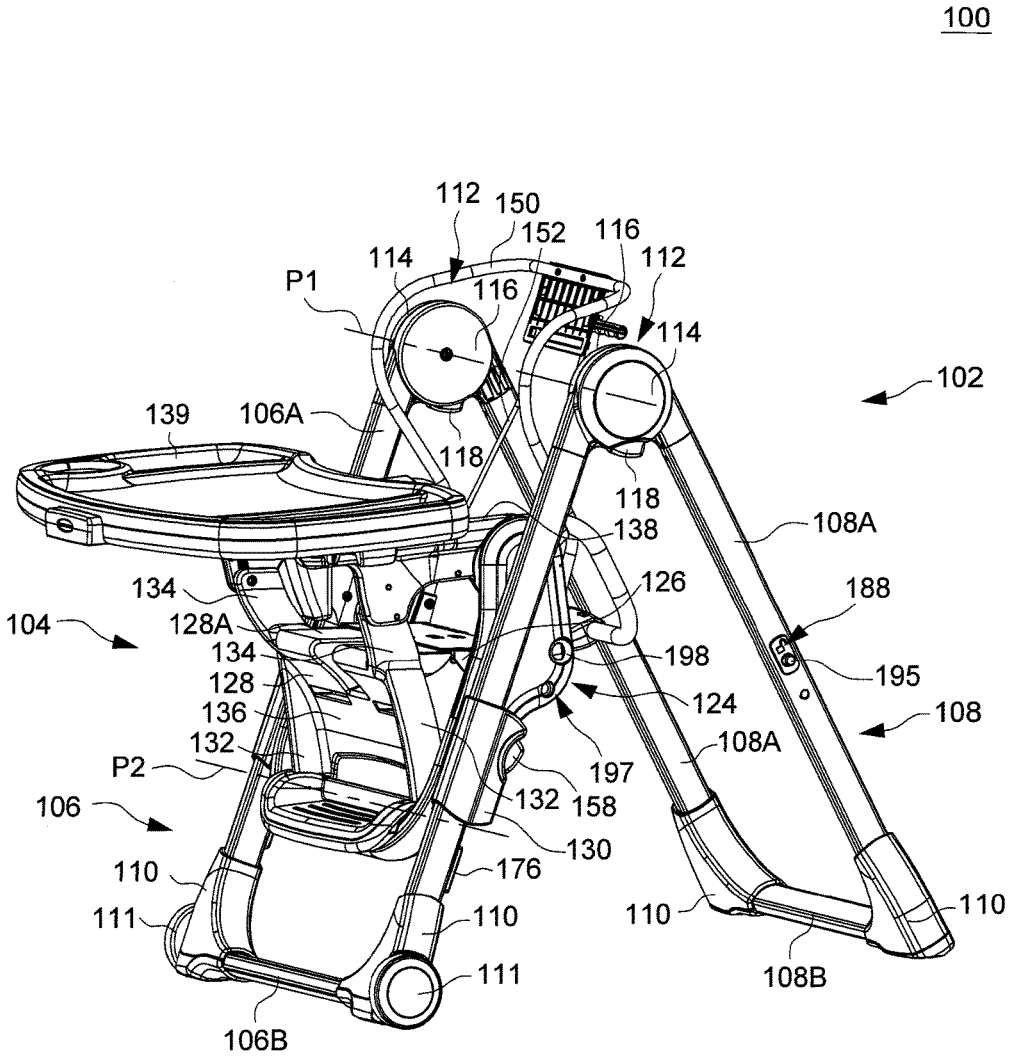
FIG. 2 is a perspective view illustrating the infant high chair shown in FIG. 1 with a seat assembly adjusted to a different height.
Figure 3:
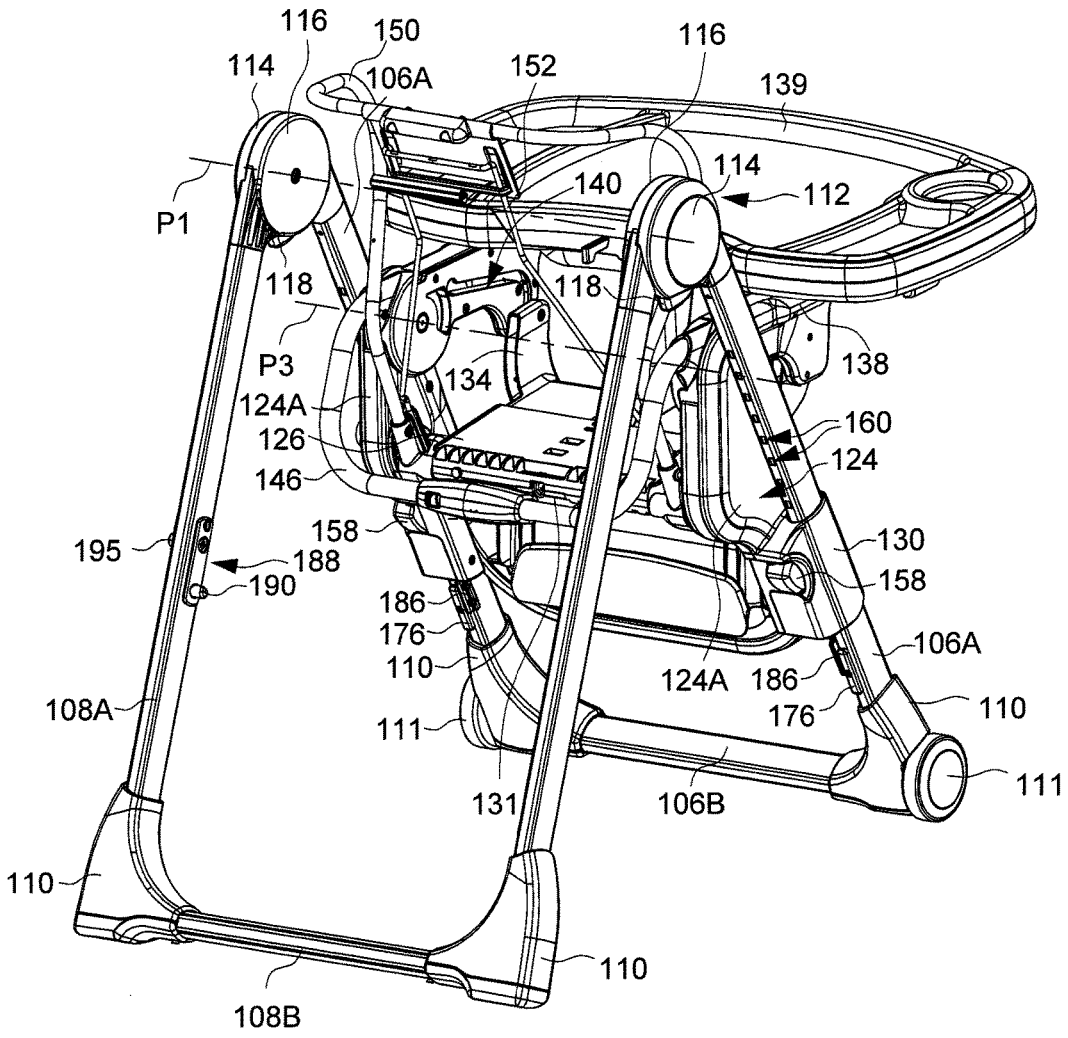
FIG. 3 is a perspective view illustrating the infant high chair shown in FIG. 2 under another angle of view.
Figure 4:
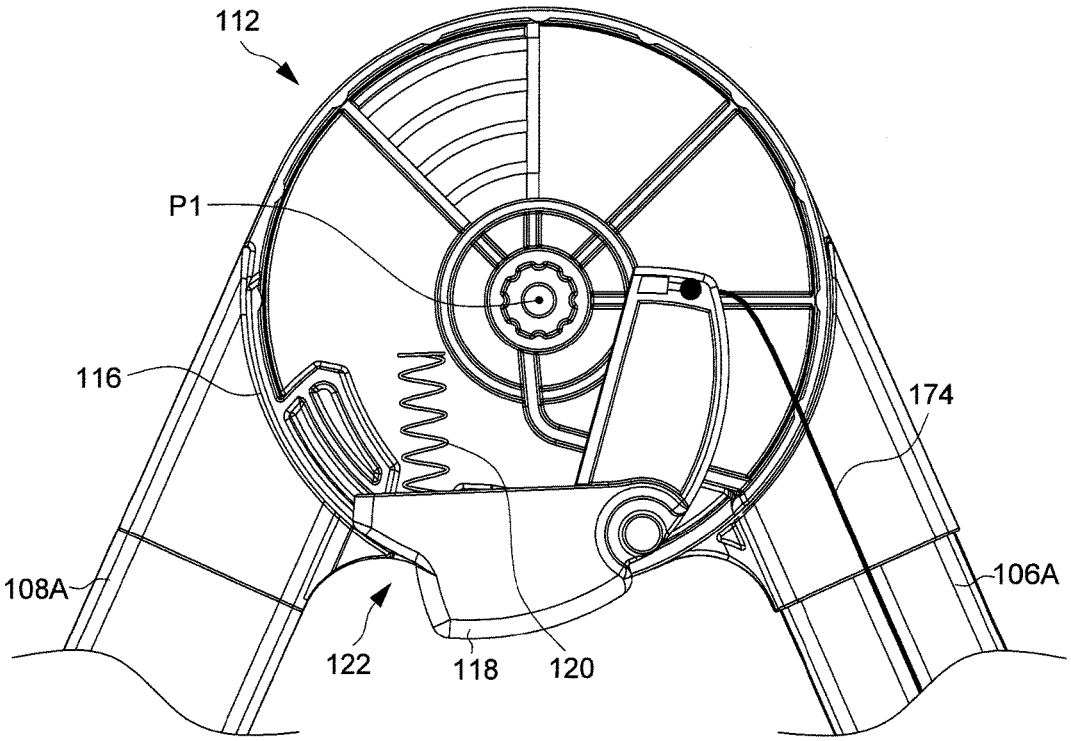
FIG. 4 is a schematic view illustrating the construction of one hinge structure connecting two leg segments of the infant high chair.
Figure 5:
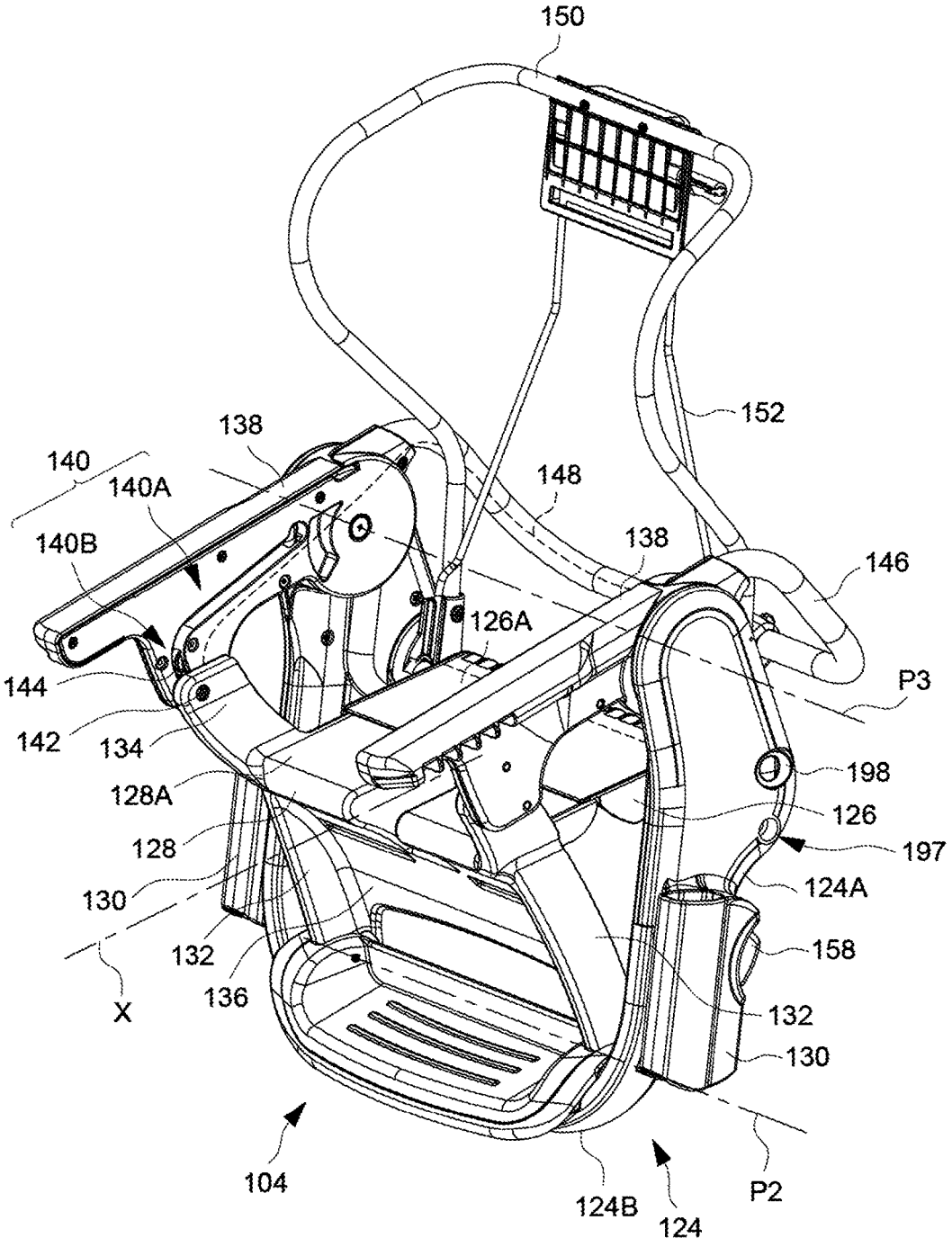
FIG. 5 is a schematic view illustrating a portion of the infant high chair including a seat assembly and two side segments.
Figure 6:
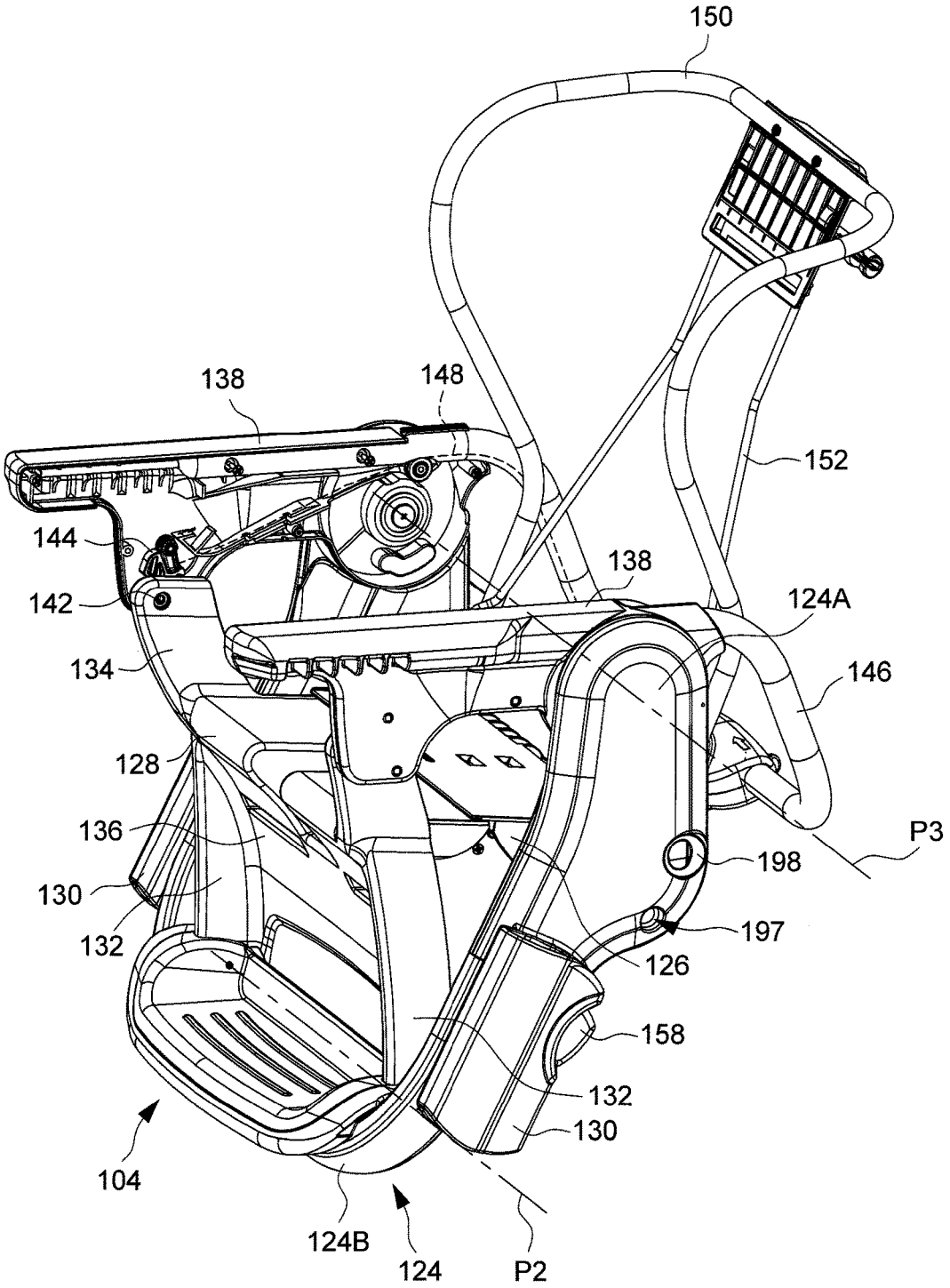
FIG. 6 is a schematic view illustrating inner construction details of a side segment including a locking member operable to lock the side segment in a deployed state.
Figure 7:
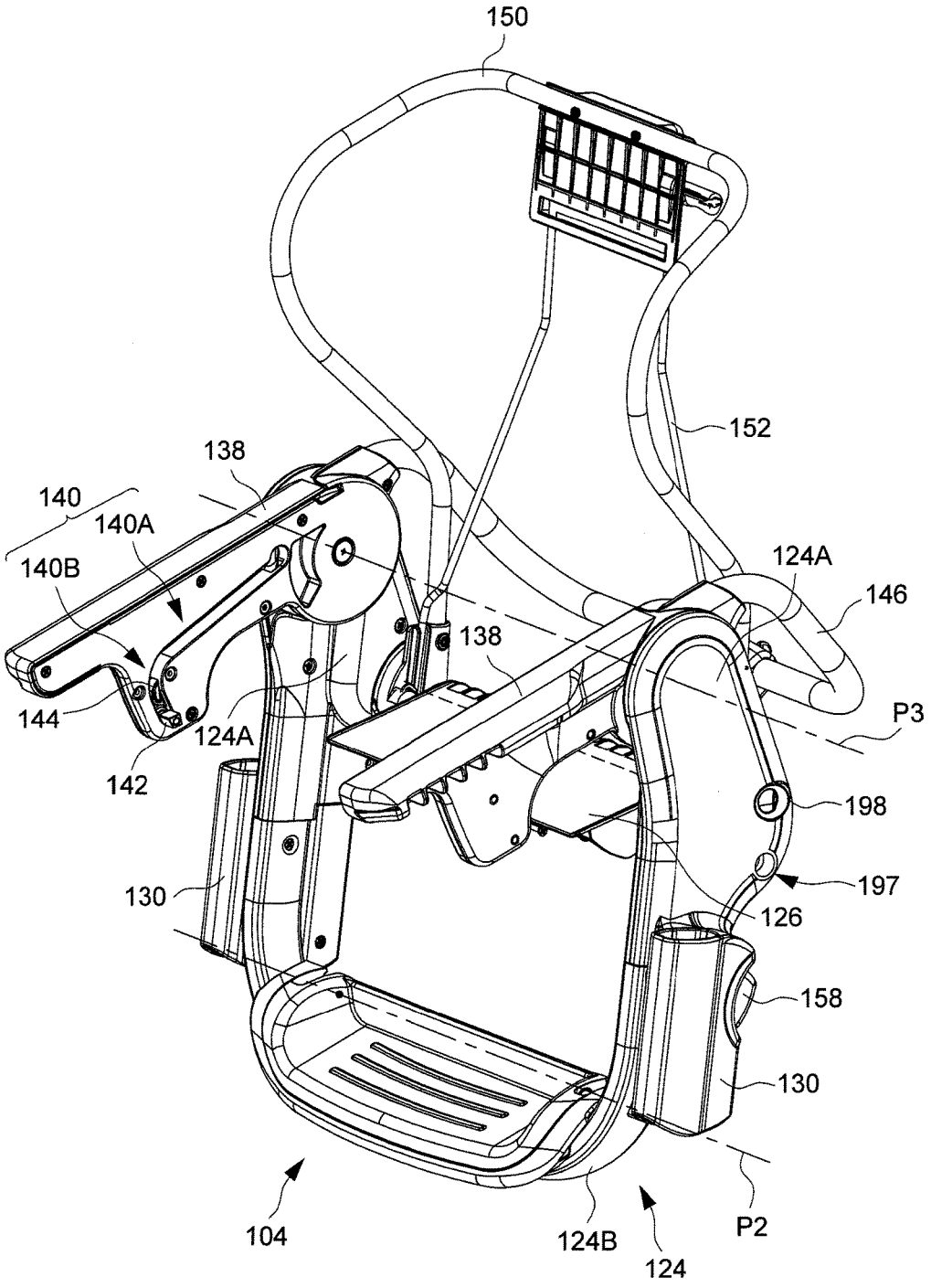
FIG. 7 is a schematic view illustrating the seat assembly without the front seat portion.

FIGS. 1-3 are schematic views illustrating an embodiment of an infant high chair 100. The infant high chair 100 can include a standing frame 102 and a seat assembly 104. The standing frame 102 can include a front leg frame 106 and a rear leg frame 108 pivotally connected with each other about a pivot axis P1. The front leg frame 106 can have two leg segments 106A, and a transversal segment 106B connected between the two leg segments 106A near the lower ends thereof. Likewise, the rear leg frame 108 can have two leg segments 108A, and a transversal segment 108B connected between the two leg segments 108A near the lower ends thereof. The lower end of each of the leg segments 106A and 108A respectively includes a foot 110 that can rest adjacent to a floor surface. Moreover, wheel assemblies 111 can be respectively provided on at least the leg segments 106A near the feet 110 to facilitate transport of the infant high chair 100.

Two hinge structures 112 can respectively connect pivotally the upper ends of the leg segments 106A with the upper ends of the leg segments 108A about the pivot axis P1. In one embodiment, the two hinge structures 112 can be similar in construction and can be arranged at a left and right upper end of the standing frame 102. In conjunction with FIGS. 1-3, FIG. 4 is a schematic view illustrating the construction of one hinge structure 112 connecting one leg segment 106A with one leg segment 108A. The hinge structure 112 can include a coupling shell 114 affixed with the leg segment 106A, another coupling shell 116 affixed with the leg segment 108A, a latching part 118 pivotally connected with the coupling shell 114, and a spring 120 having two ends respectively anchored with the latching part 118 and a fixed point of the coupling shell 114. For clarity, a portion of the coupling shell 114 is omitted in the representation of FIG. 4 to better show the arrangement of the latching part 118 and the spring 120. The latching part 118 can rotate relative to the coupling shells 114 and 116 to engage and disengage an opening 122 formed through the coupling shell 116. The engagement of the latching part 118 with the opening 122 can lock the leg segments 106A and 108A in an unfolded state, and the disengagement of the latching part 118 from the opening 122 can allow collapse of the leg segments 106A and 108A by rotation about the pivot axis P1.

Referring to FIGS. 1-3, the seat assembly 104 can include a seat support frame 124 movably connected with the standing frame 102, and a rear seat portion 126 and a front seat portion 128 respectively connected with the seat support frame 124. The seat support frame 124 can include two lateral portions 124A respectively arranged at a left and a right side of the infant high chair 100, and a transversal portion 124B fixedly connected with the lateral portions 124A at the lower portions thereof. The lateral portions 124A can be respectively affixed with sleeves 130 through which the leg segments 106A of the front leg frame 106 are slidably assembled, so that the seat support frame 124 is movable along the leg segments 106A for vertical adjustment of the seat assembly 104 relative to the standing frame 102. The transversal portion 124B can be configured as a footrest for a child sitting on the seat assembly 104.

The rear seat portion 126 can have an upper surface 126A for receiving a child in a sitting position, and can be connected with the seat support frame 124. For example, the seat support frame 124 can be affixed with a shaft portion 131 (as shown in FIG. 3) extending transversally, and a rear region of the rear seat portion 126 can be connected with the shaft portion 131. In one embodiment, some degrees of rotation of the rear seat portion 126 relative to the seat support frame 124 may be allowed, e.g., by pivotally connecting the rear seat portion 126 with the seat support frame 124 about the shaft portion 131.

The front seat portion 128 can have an upper surface 128A, and a left and a right side respectively affixed with two extensions 132 and 134. The extensions 132 and 134 can respectively project downward and upward relative to the upper surface 128A, and can be arranged near a front end of the front seat portion 128. The extensions 132 can be respectively connected pivotally with the lateral portions 124A of the seat support frame 124 about a pivot axis P2. Moreover, the front seat portion 128 can further include an abuttal panel 136 having a left and a right side respectively affixed with the two extensions 132. The abuttal panel 136 can extend downward from the upper surface 128A at the front end of the front seat portion 128, and can provide support for a child's legs.

Referring to FIGS. 1-3, the seat assembly 104 can further include two arm bars, also referred to as side segments 138 respectively arranged at the left and right sides of the seat assembly 104. The two side segments 138 can have a generally similar shape, and can be respectively connected pivotally with the lateral portions 124A of the seat support frame 124 about a pivot axis P3. The pivot axis P3 is located above the upper sitting surface of the seat assembly 104 and near the rear ends of the side segments 138. The side segments 138 can be rotatable about the pivot axis P3 relative to the seat support frame 124 between a deployed state in which the side segments 138 extend substantially parallel to and above the sitting surface of the seat assembly 104 (as shown in FIG. 1), and a folded state in which the side segments 138 are inclined downward to lie substantially parallel to the leg segments 106A of the front leg frame 106 (as exemplary shown in FIGS. 18-20). As better shown in FIGS. 2 and 3, the side segments 138 can be attached with a tray 139 on which food and drink for a child can be placed. The tray 139 may be removably attached with the side segments 138, and extend transversally relative to the seat assembly 104. When the tray 139 is removed, the side segments 138 may serve as armrests of the seat assembly 104.

FIGS. 5-8 are schematic views illustrating construction details of the side segment 138 and the seat assembly 104. For clarity, the tray 139 is not represented in FIGS. 5-8. The two side segments 138 are movably connected with the two extensions 134, respectively. More specifically, each of the side segments 138 can include a guide slot 140 having an elongated portion 140A extending from a rear toward a front of the side segment 138, and a turn portion 140B toward the front of the side segment 138. Each of the extensions 134 of the front seat portion 128 can respectively include a protrusion 142 that can be guided for sliding movement along one corresponding guide slot 140 in a region forward from the pivot axis P3 of the side segment 138. Accordingly, the front seat portion 128 is respectively connected with the seat support frame 124 and the side segments 138 at two vertically spaced-apart locations forward from the pivot axis P3.

Figure 8:
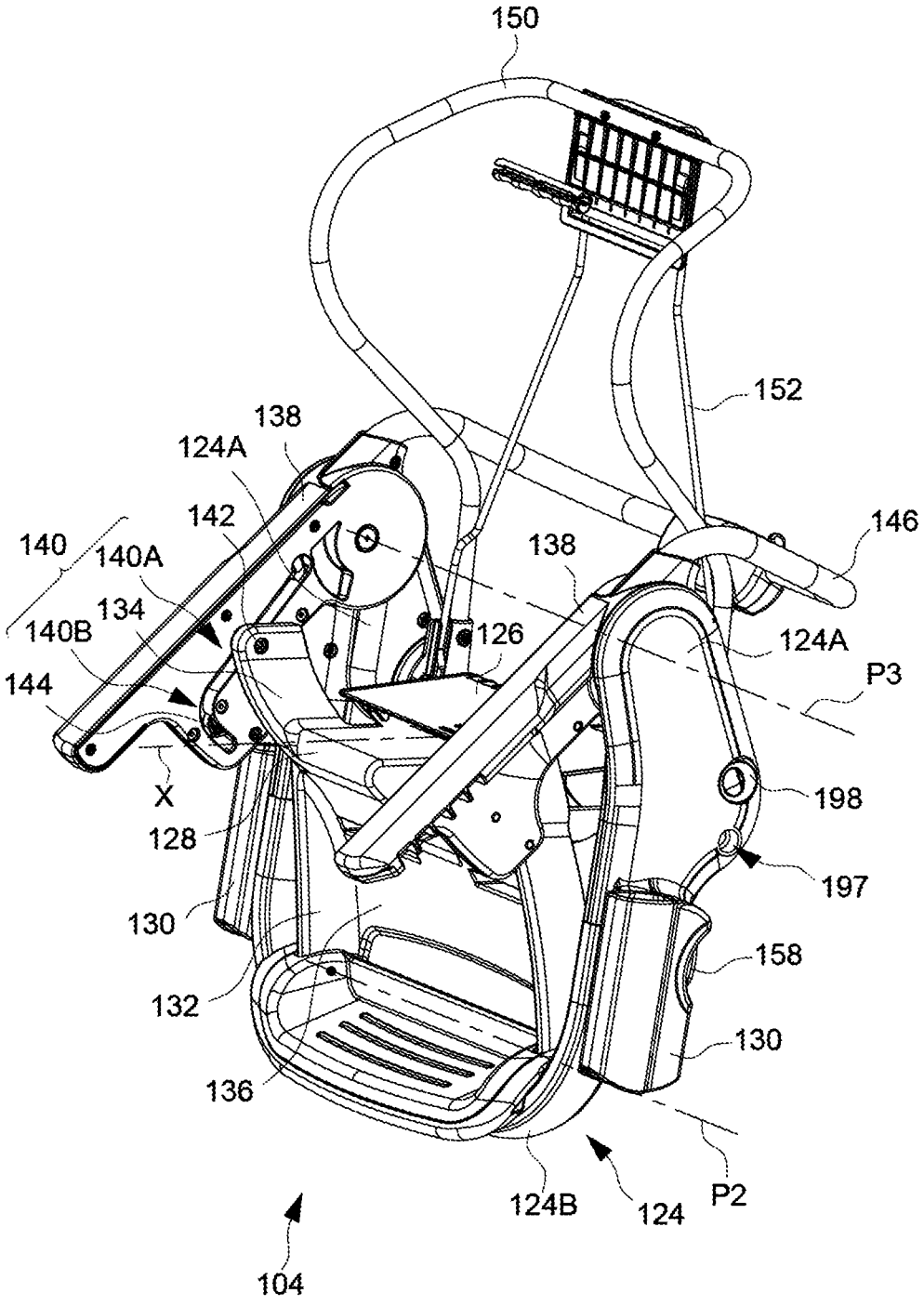
FIG. 8 is a schematic view illustrating the side segments rotated downward relative to the seat assembly.

The sliding connection between the protrusion 142 and the guide slot 140 is such that a rotation of the side segments 138 in a folding direction from the deployed state toward the folded state can drive rearward sliding of the front seat portion 128 relative to the rear seat portion 126 along a lengthwise axis X extending from a front to a rear of the seat assembly 104. In particular, as schematically shown in FIG. 8, a downward rotation of the side segments 138 about the pivot axis P3 toward the folded state can cause a sliding movement of each protrusion 142 toward a rearward end of the corresponding guide slot 140, which can drive the front seat portion 128 to slide rearward along the lengthwise axis X toward an underside of the rear seat portion 126. The rear seat portion 126 and the front seat portion 128 can be thereby arranged in a contracted state that reduces the front-to-rear length of the seat assembly 104 for convenient storage. When the seat assembly 104 needs to be opened for use, the side segments 138 can be rotated about the pivot axis P3 from the folded state to the deployed state, which results in a reverse sliding movement of each protrusion 142 toward a forward end of the corresponding guide slot 140. As a result, the front seat portion 128 is driven to slide forward relative to the rear seat portion 126 for expanding the seat assembly 104. The upper surfaces 126A and 128A of the rear and front seat portions 126 and 128 in the expanded state can thereby form an enlarged sitting surface for receiving a child.

Referring to FIGS. 5-8, each of the side segments 138 can further include a locking member 144 for locking the side segment 138 in the deployed state. The locking member 144 can be pivotally assembled with the side segment 138 adjacent to an inner sidewall of the guide slot 140. When the side segment 138 is in the deployed state, the protrusion 142 is located at an end of the guide slot 140 adjacent to the turn region 140B, and the locking member 144 can be spring biased to project into the guide slot 140 so as to block displacement of the protrusion 142 along the guide slot 140 in a folding direction. The locking member 144 can be operable to retract into the sidewall of the guide slot 140 to clear the way for movement of the protrusion 142 along the guide slot 140 for folding the side segment 138.

As shown, the two side segments 138 can be further affixed with a handle bar 146. The handle bar 146 can be profiled so as to be easily grasped by a caregiver for operating and moving the two side segments 138 and the seat assembly 104. In one embodiment, the handle bar 146 can exemplary bend downward at a rear of the side segments 138. The locking member 144 in each side segment 138 can be respectively connected with a common release button 147 arranged on the handle bar 146 via a wire 148 (shown with phantom lines in FIGS. 5 and 6). Each of the two wires 148 can be routed along an interior of the handle bar 146, and have two opposite ends respectively coupled with the locking member 144 and the release button 147. A caregiver can thus use one hand to operate the release button 147 to drive concurrent unlocking of the locking members 144, and at the same time desirably rotate the side segments 138.

Referring to FIGS. 1-8, the seat assembly 104 can be further assembled with a backrest frame 150. The backrest frame 150 can be pivotally connected with the seat support frame 124 near the rear seat portion 126, e.g., the backrest frame 150 can be pivotally about the shaft portion 131. A latch mechanism (not shown) may be provided to lock the backrest frame 150 at any of multiple angular positions, and an actuating rod 152 may be operable to cause unlocking of the latch mechanism for allowing recline adjustment of the backrest frame 150. For example, at each of the two ends of the shaft portion 131, the latch mechanism can include a toothed part affixed with the seat support frame 124, a latch slidable along the shaft portion 131 to engage and disengage the toothed part, and a spring biasing the latch to engage with the toothed part for locking the backrest frame 150 in position. The actuating rod 152 may be pulled upward to cause disengagement of the latch (e.g., by the interaction of ramped surfaces) for allowing angular adjustment of the backrest frame 150. In some embodiment, the latch may also have a saw-shaped teeth so that the engagement of the latch can block rotation of the backrest frame 150 in one direction (e.g., in a recline direction), while allowing rotation in the other direction (e.g., in an upright direction) without the need of operating the actuating rod 152.

As described previously, the seat assembly 104 is adjustable vertically relative to the standing frame 102. In conjunction with FIGS. 1-8, FIG. 9 is a schematic view illustrating a lock mechanism 154 operable to lock the seat assembly 104 at different heights on the standing frame 102. The lock mechanism 154 can be assembled in one lateral portion 124A of the seat support frame 124 at a location adjacent to the sleeve 130, and can include a latch 155, a spring 156 and a release actuating portion 158. The same lock mechanism 154 can be respectively arranged at each of the left and the right side of the seat assembly 104 below the pivot axis P3 of the side segment 138. The latch 155 is pivotally connected with the lateral portion 124A of the seat support frame 124 adjacent to one corresponding leg segment 106A, and can rotate about a pivot axis P4 that extends transversally from a left to a right side of the seat assembly 104. The leg segment 106A can include a plurality of openings 160 (better shown in FIG. 10) that are distributed along a length of the leg segment 106A to define multiple locking positions for the seat assembly 104. The latch 155 is rotatable to engage with any the openings 160 of the leg segment 106A for locking the seat assembly 104 at a desirable height, or disengage from the openings 160 to allow vertical displacement of the seat assembly 104 along the leg segment 106A.

The spring 156 can have two opposite ends respectively connected with the latch 155 and a fixed point in the lateral portion 124A of the seat support frame 124. The spring 156 can bias the latch 155 toward a locking state for engagement with the leg segment 106A.

The release actuating portion 158 is affixed with the latch 155 below the pivot axis P3 of the side segment 138, and is rotatable about the same pivot axis P4 of the latch 155. In one embodiment, the release actuating portion 158 can be provided as a separate part fixedly secured with the latch 155. In other embodiments, the release actuating portion 158 may be formed integrally with the latch 155. The release actuating portion 158 is accessible from outside the lateral portion 124A of the seat support frame 124 for operation, and can be depressed to cause rotation of the latch 155 to an unlocking state for disengaging from the leg segment 106A.

Exemplary operation of the lock mechanism 154 is described hereinafter with reference to FIGS. 3 and 9. At each of the left and right side of the infant high chair 100, the latch 155 can respectively engage with the corresponding leg segment 106A to lock the seat assembly 104 with the standing frame 102. When a caregiver wants to change the vertical position of the seat assembly 104, each release actuating portion 158 can be independently depressed to cause the corresponding latch 155 to disengage from the leg segment 106A. This operation of the release actuating portion 158 can be conducted while the side segment 138 remains in the deployed position described previously. The unlocked seat assembly 104 then can slide along the leg segments 106A until it reaches a desirable height. Once the seat assembly 104 is placed at the desired height, the spring 156 can urge the latch 155 to engage with one corresponding opening 160 of the leg segment 106A to hold the seat assembly 104 in position. Examples of vertical positions that can be occupied by the seat assembly 104 can include one or more vertical positions where the side segments 138 lie above the hinge structures 112 (as shown in FIG. 1), and one or more vertical positions where the side segments 138 lie below the hinge structures 112 (as shown in FIGS. 2 and 3).

In one advantageous mode of use, the position of the seat assembly 104 can be lowered near the level of the feet 110 of the standing frame 102 when the infant high chair 100 is collapsed, so that the overall height of the folded infant high chair 100 can be reduced for facilitating storage. Moreover, the infant high chair 100 described herein can have a link mechanism that allows easy collapse without requiring a caregiver to proceed with multiple manual unlocking steps. In conjunction with FIG. 9, FIGS. 10 and 11 are schematic views illustrating a link mechanism 159 that can be assembled in the lateral portion 124A of the seat support frame 124 at each of the left and right side of the infant high chair 100 to achieve the aforementioned functions. FIG. 10 is a schematic view representing illustrating the link mechanism 159, and FIG. 11 is a schematic enlarged view illustrating a portion of the link mechanism 159 around a region encompassing the release actuating portion 158.

Figure 9:
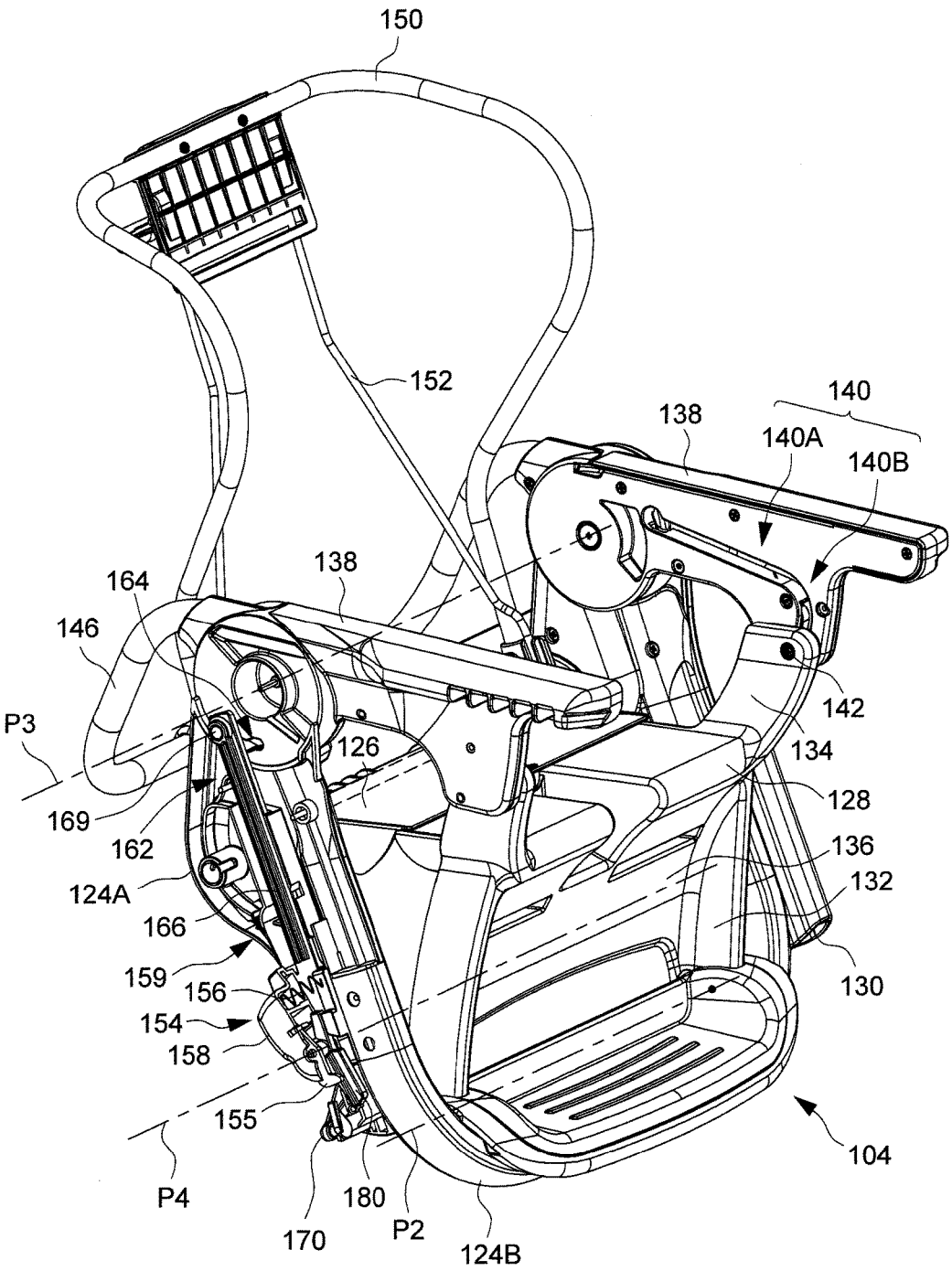
FIG. 9 is a schematic view illustrating a lock mechanism operable to lock the seat assembly of the infant high chair at different heights.
Figure 10:
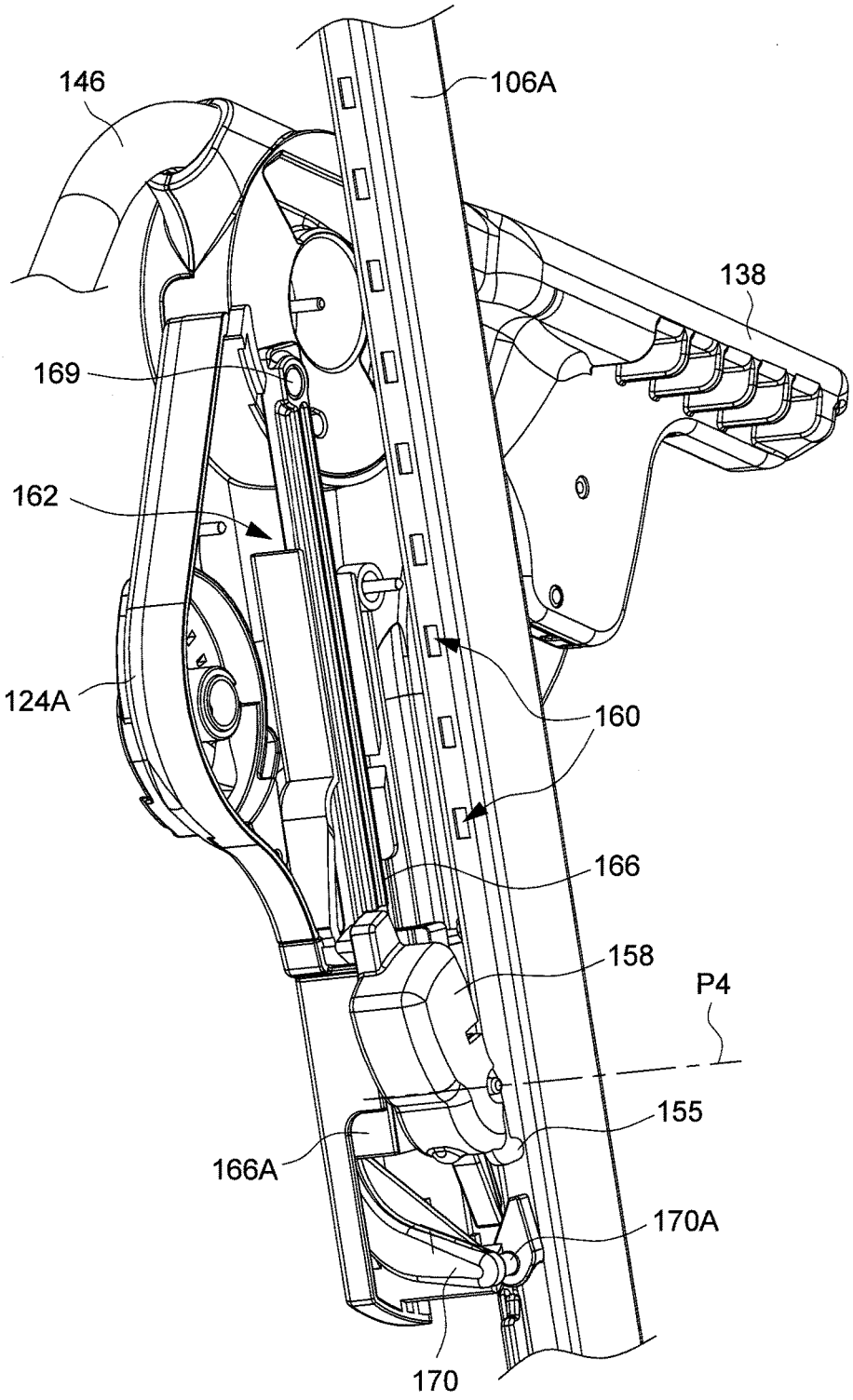
FIG. 10 is a schematic view illustrating a link mechanism that couples a side segment with the lock mechanism shown in FIG. 9.
Figure 11:
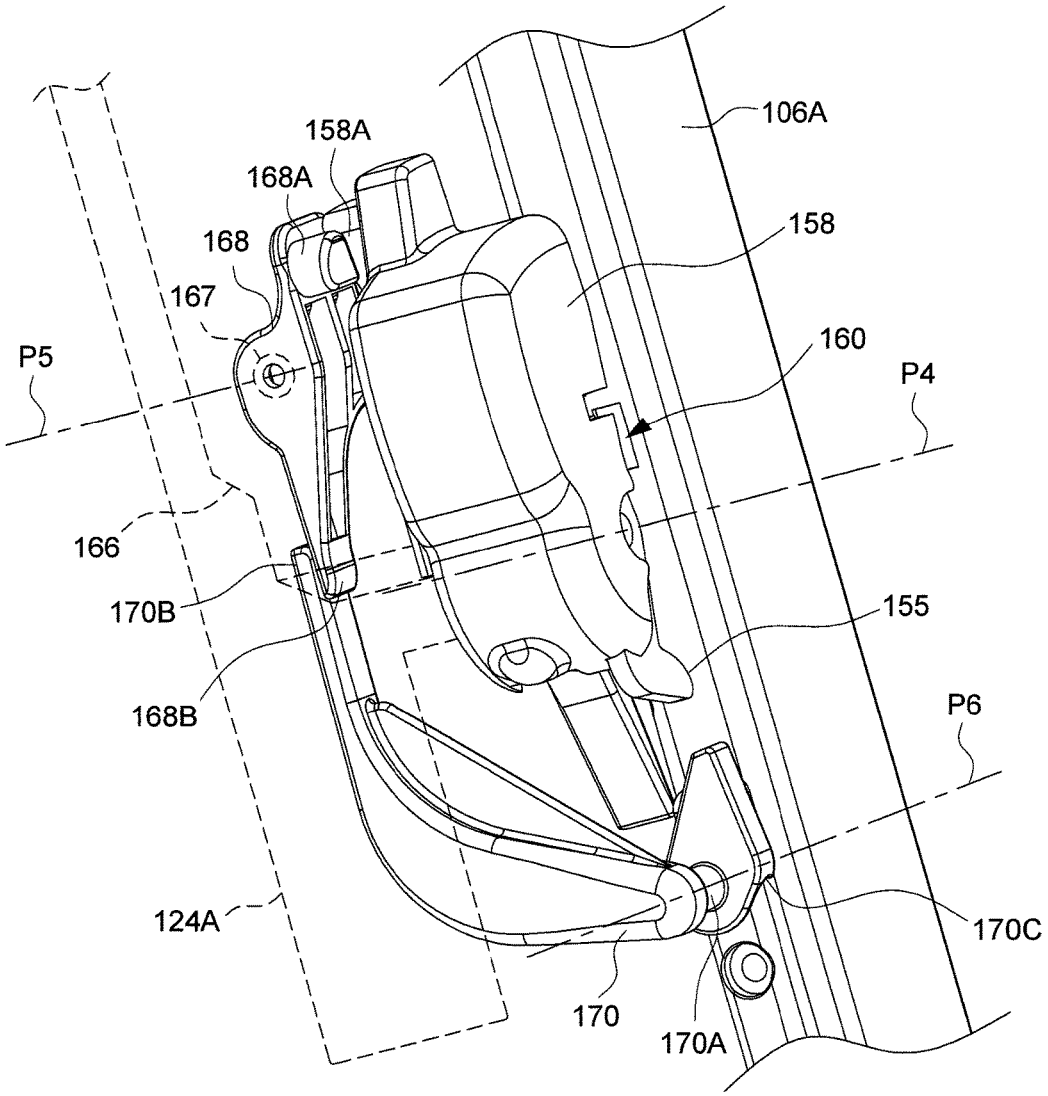
FIG. 11 is a schematic enlarged view illustrating a lower portion of the link mechanism including a rocker.

Referring to FIGS. 9-11, the link mechanism 159 can include a linkage 162 that is assembled for up and down sliding movement through an interior of the lateral portion 124A of the seat support frame 124. The side segment 138 can have a guide track 164, the release actuating portion 158 can be provided with a ramped surface 158A, and the linkage 162 can respectively have an upper portion guided for movement along the guide track 164 and a lower portion in sliding contact with the ramped surface 158A. The linkage 162 can thereby operatively connect the side segment 138 with the corresponding lock mechanism 154, such that a rotation of the side segment 138 in a folding direction can drive an upward sliding displacement of the linkage 162 that actuates the lock mechanism 154 to unlock, thereby allowing vertical adjustment of the seat assembly 104 relative to the standing frame 102.

In one embodiment, the linkage 162 can include an elongated beam 166 and a rocker 168 pivotally connected with each other. The beam 166 is assembled in the lateral portion 124A for up and down sliding movement, and has an upper portion provided with a protuberance 169 that can be guided for movement along the guide track 164. Moreover, the beam 166 can include a hollow portion 166A in which is assembled the rocker 168. For clarity, portions of the beam 166 and the lateral portion 124A is represented with dotted lines in FIG. 11 to better show the arrangement of the rocker 168. The rocker 168 is arranged at a lower portion of the beam 166 and has a protrusion 168A that come in sliding contact with the ramped surface 158A of the release actuating portion 158. The rocker 168 can be pivotally connected with the beam 166 about a pivot axis P5. While the pivot axis P4 of the latch 155 and the release actuating portion 158 extends generally transversally from a left to a right side of the infant high chair 100, the pivot axis P5 of the rocker 168 extends generally longitudinally from a rear toward a front of the infant high chair 100. A plane of rotation of the rocker 168 can be substantially perpendicular to a plane of rotation of the latch 155 and the release actuating portion 158.

The rocker 168 can be further connected with a spring 167 (shown with phantom lines in FIG. 11) configured to bias the rocker 168 toward a position engaged with the ramped surface 158A of the release actuating portion 158. The spring 167 can exemplary be a torsion spring arranged around the pivot axis P5 of the rocker 168.

Figure 12:
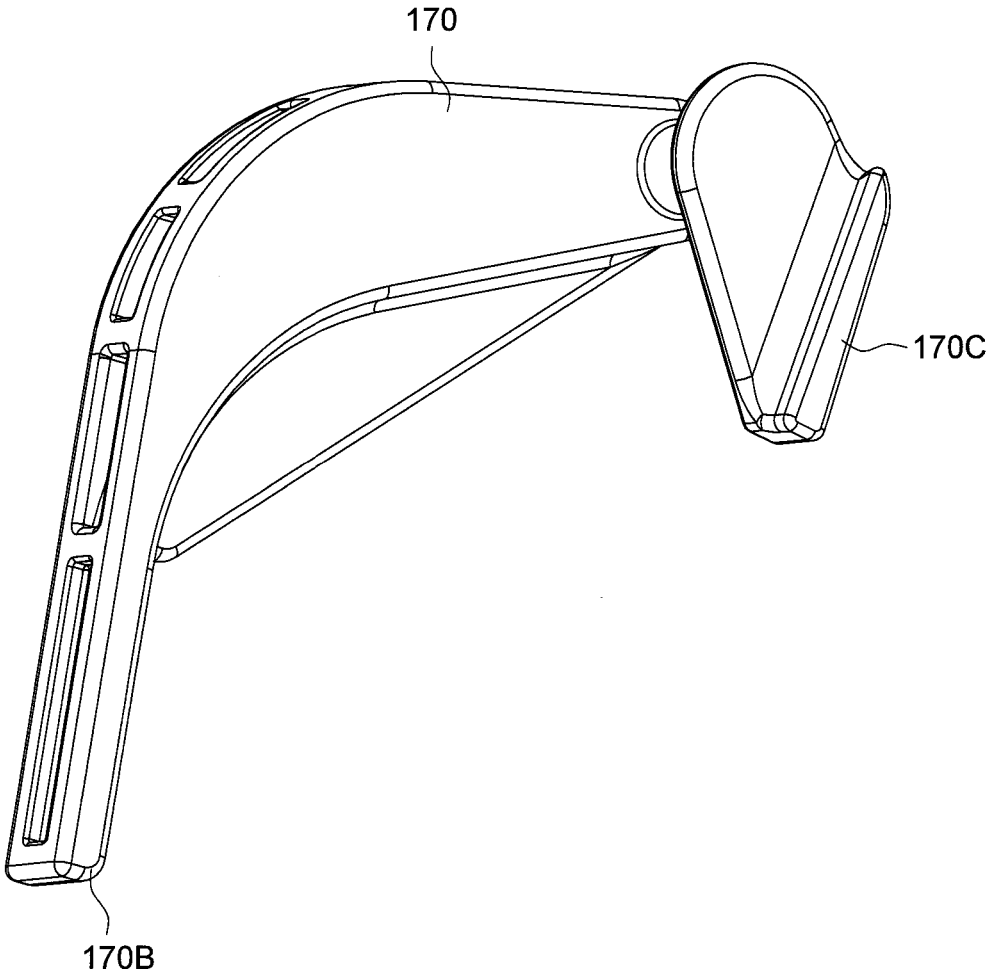
FIG. 12 is a schematic view illustrating a lever used with the link mechanism shown in FIG. 11.

Referring to FIGS. 10 and 11, the lateral portion 124A of the seat support frame 124 can be further assembled with a lever 170 that is disposed adjacent to the rocker 168. The lever 170 is shown alone in FIG. 12. The lever 170 is pivotally connected with the lateral portion 124A about a pivot axis P6 located below the latch 155 and the release actuating portion 158. The pivotal connection of the lever 170 with the lateral portion 124A can be made at a shaft portion 170A of the lever 170. The pivot axis P6 extends generally longitudinally from a rear toward a front of the infant high chair 100, and is substantially parallel to the pivot axis P5 of the rocker 168. An end portion 170B of the lever 170 offset from the pivot axis P6 is arranged adjacent to an end portion 168B of the rocker 168, the end portion 168B being located at a side opposite to that of the protrusion 168A with respect to the pivot axis P5 of the rocker 168. Moreover, the lever 170 can have a ramped surface 170C (better shown in FIG. 12) that is offset from the pivot axis P6 and is located below the latch 155 and the release actuating portion 158.

Figure 13:
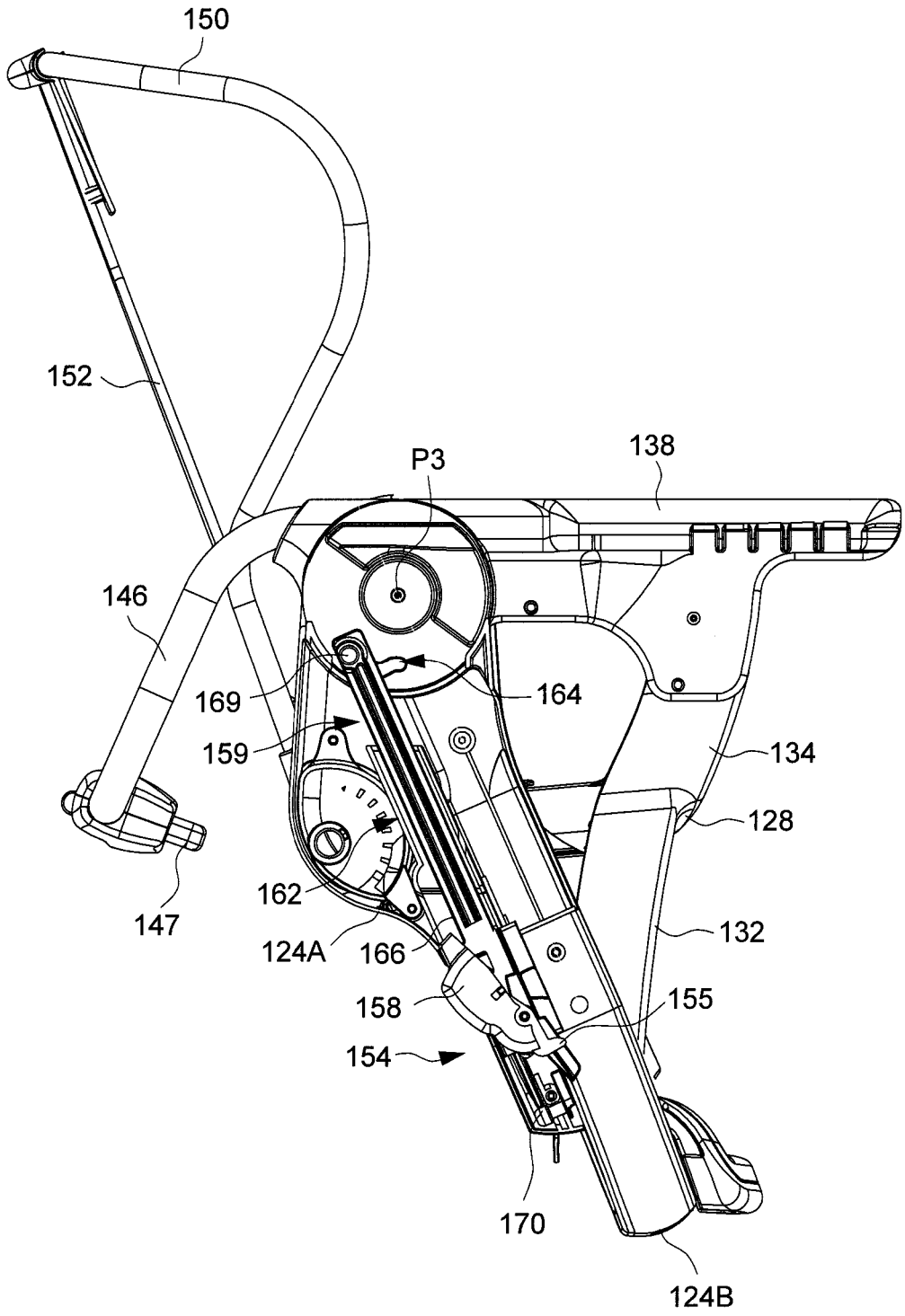
FIGS. 13 and 14 are schematic views illustrating exemplary operation of the link mechanism that couples a folding rotation of the side segment with an unlocking movement of the lock mechanism.

In conjunction with FIGS. 9-11, FIGS. 13 and 14 are schematic views illustrating exemplary operation of the link mechanism 159. In FIG. 13, the side segment 138 is shown in the deployed state extending substantially horizontal and parallel to upper sitting surfaces of the rear and front seat portions 126 and 128. In this deployed state, the protuberance 169 of the beam 166 is located adjacent to a first end of the guide track 164, and the linkage 162 can be at a downward position allowing independent movement of the latch 155 in a locking and an unlocking direction. While the side segment 138 is in the deployed state, the latch 155 thus can unlock for vertical adjustment of the seat assembly 104, and engage with the leg segment 106A to lock the seat assembly 104 at a desired height.

Figure 14:
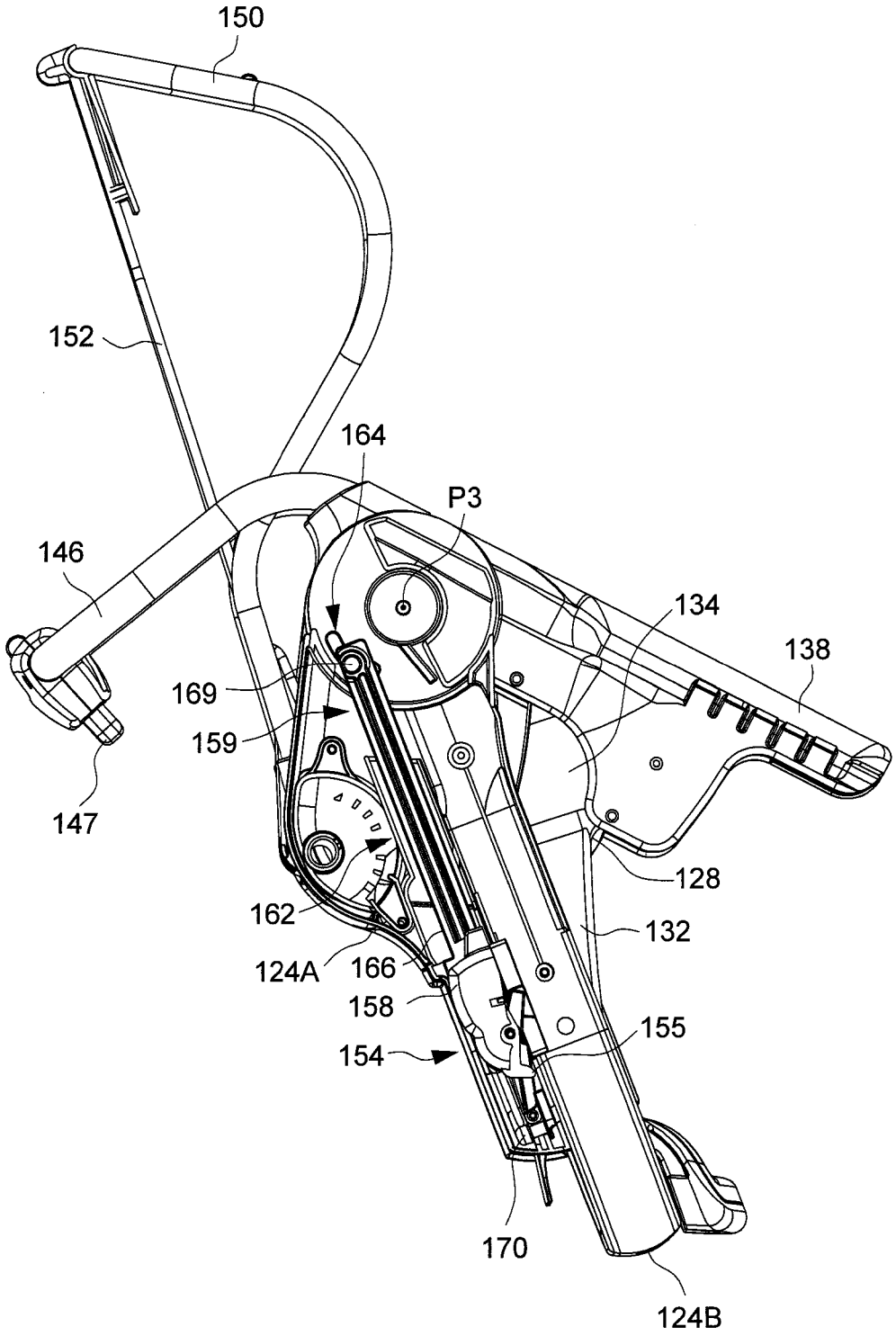

Referring to FIG. 14, for collapsing the seat assembly 104, the side segment 138 can be rotated downward about the pivot axis P3 to a folded state, which results in a relative displacement of the protuberance 169 of the linkage 162 along the guide track 164 of the side segment 138. Owing to the sliding interaction between the protuberance 169 and the guide track 164, this downward rotation of the side segment 138 can drive the linkage 162 (including the beam 166 and the rocker 168) to slide upward relative to the lateral portion 124A of the seat support frame 124 from the downward position to an upward position. This upward movement of the linkage 162 causes the protrusion 168A (better shown in FIG. 11) to push against the ramped surface 158A of the release actuating portion 158, which drives the release actuating portion 158 and the latch 155 to rotate in a direction for disengaging from the leg segment 106A. The seat assembly 104 is thereby unlocked, and can be lowered to a lower position near the foot 110 of the leg segment 106A while the side segment 138 is in the folded state. The linkage 162 and the lever 170 can move along with the seat assembly 104 as the seat assembly 104 is lowered to the lower position.

Figure 15:
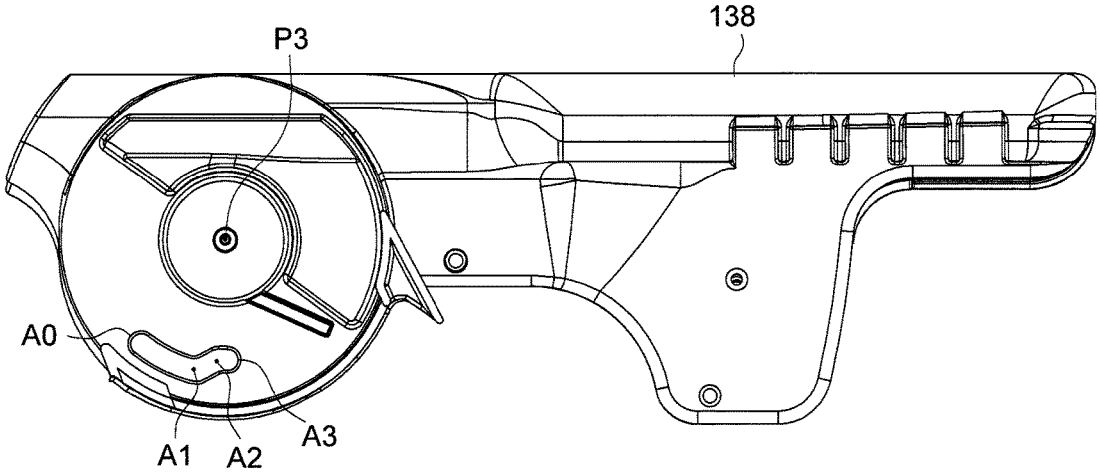
FIG. 15 is a schematic view illustrating a guide track provided in a side segment of the infant high chair.

Referring to FIG. 15, the guide track 164 can be exemplary divided into three sections. A first section of the guide track 164 can be defined between a first end A0 and a first intermediate location A1 of the guide track 164, the first end A0 corresponding to the deployed state of the side segment 138, and the first intermediate location A1 corresponding to a downward rotation of the side segment 138 of about 28 degrees from the deployed state. A second section of the guide track 164 can be defined between the first intermediate location A1 and a second intermediate location A2 corresponding to a downward rotation of the side segment 138 of about 58 degrees. A third section of the guide track 164 can be defined between the second intermediate location A2 and the second end A3 of the guide track 164 corresponding to a fully folded state of the side segment 138, the fully folded state being reached with a downward rotation of about 66 degrees from the deployed state. The first section between the first end A0 and the first intermediate location A1 of the guide track 164, and the third section between the second intermediate location A2 and the second end A3 of the guide track 164, can have a profile that does not pull the linkage 162 upward, i.e., the linkage 162 can remain substantially in place while the protuberance 169 slides along those sections. In other words, during the movement of the protuberance 169 along the first section and the third section of the guide track 164, the radial distance between the protuberance 169 and the pivot axis P3 is substantially the same. The second section between the first and second intermediate locations A1 and A2 of the guide track 164 can have another profile configured to drive a vertical displacement of the linkage 162 while the protuberance 169 slides along the second section. In other words, during the movement of the protuberance 169 along the second section of the guide track 164 from first intermediate location A1 toward the second intermediate location A2, the radial distance between the protuberance 169 and the pivot axis P3 decreases.

Figure 16:
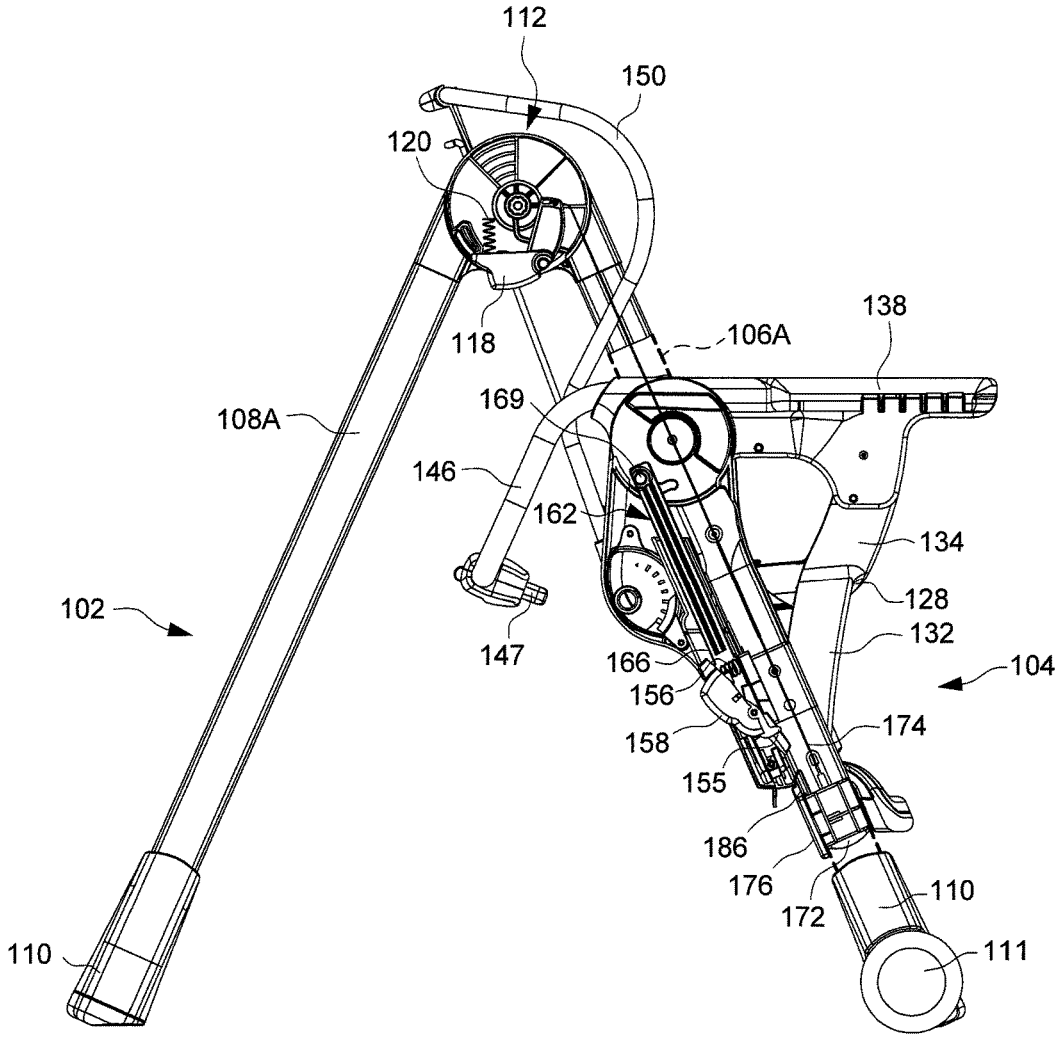
FIG. 16 is a schematic view illustrating the inner construction of a leg segment of the infant high chair including a release actuator disposed near a foot of the leg segment.

FIG. 16 is a schematic view illustrating an inner construction of the leg segment 106A. A release actuator 172 can be arranged in the leg segment 106A close to the foot 110 thereof. The release actuator 172 can be movable relative to the leg segment 106A, and can be operatively connected with the latching part 118 at the top of the leg segment 106A via a wire 174. The wire 174 can be arranged along an interior of the leg segment 106A, and can have two opposite ends respectively anchored with the release actuator 172 and the latching part 118.

The leg segment 106A is further provided with a tab 176 that is arranged adjacent to the release actuator 172 and projects at an outer side of the leg segment 106A. In one embodiment, the tab 176 can be affixed with the release actuator 172. In another embodiment, the tab 176 may be affixed with the leg segment 106A. A same assembly of the release actuator 172, the wire 174 and the tab 176 may be arranged on each of the left and right leg segments 106A.

As the seat assembly 104 moves downward to the lower position near the foot 110 with the side segment 138 in the folded state, a portion of the seat support frame 124 (e.g., the lateral portion 124A thereof) can contact and push the release actuator 172 downward. This downward displacement of the release actuator 172 can pull on the wire 174, which actuates the latching part 118 to rotate for unlocking the standing frame 102, thereby allowing folding of the standing frame 102. Because the lower position of the seat assembly 104 near the foot 110 allows to trigger unlocking of the standing frame 102, that position can also be referred to as a trigger position.

Figure 17:
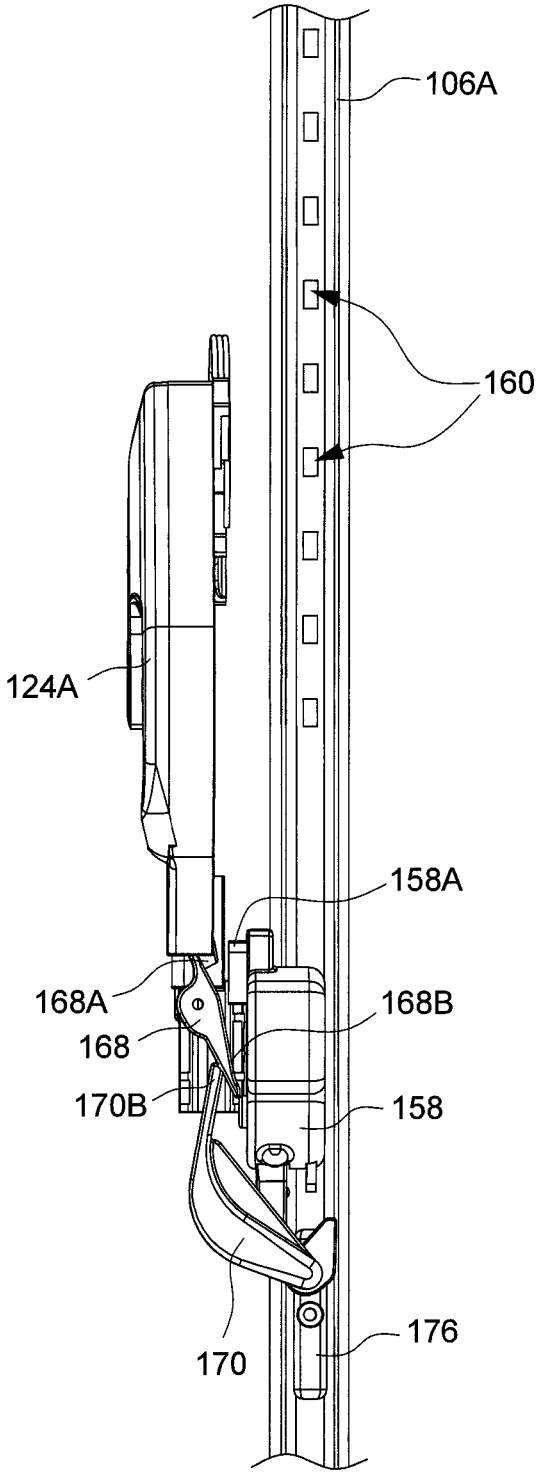
FIG. 17 is a schematic view illustrating exemplary operation of the lever during a folding procedure of the infant high chair.

In conjunction with FIG. 16, FIG. 17 is a schematic view illustrating the interaction of the lever 170 with the tab 176 during folding of the infant high chair 100. While the seat assembly 104 travels downward to the trigger or lower position near the foot 110 with the side segment 138 in the folded state, the ramped surface 170C of the lever 170 can come in contact against the tab 176, which consequently pushes the lever 170 in rotation to press against the rocker 168. As a result, the rocker 168 is urged in rotation to disengage from the ramped surface 158A of the release actuating portion 158, thereby allowing a locking displacement of the latch 155 biased by the spring 156 independently from the folded position of the side segment 138. In other words, the locking function of the latch 155 can be reset by the lever 170 once the seat assembly 104 reaches the trigger or lower position near the foot 110. In this manner, when the infant high chair 100 is unfolded and the seat assembly 104 moved upward from the lower position, the latch 155 can be biased by the spring 156 to automatically engage with an opening 160 of the leg segment 106A for locking the seat assembly 104 at a desirable height, even if the side segments 138 are in the folded state. This can advantageously facilitate unfolding of the infant high chair 100 from the collapse state. The actuation of the lever 170 by the tab 176 for allowing independent movement of the latch 155 can occur slightly before, slightly after, or approximately at the same time as the actuation of the release actuator 172 by the seat assembly 104 for unlocking the latching part 118.

In conjunction with FIGS. 1-17, FIGS. 18-20 are schematic views illustrating exemplary operation for collapsing the infant high chair 100. In FIG. 1, the infant high chair 100 is shown in a deployed state adapted to receive a child. In this deployed state, the side segments 138 extend substantially horizontal, and the rear and front seat portion 126 and 128 are expanded relative to each other. Moreover, the lock mechanism 154 can engage with the leg segments 106A to lock the seat assembly 104 in position.

Figure 18:
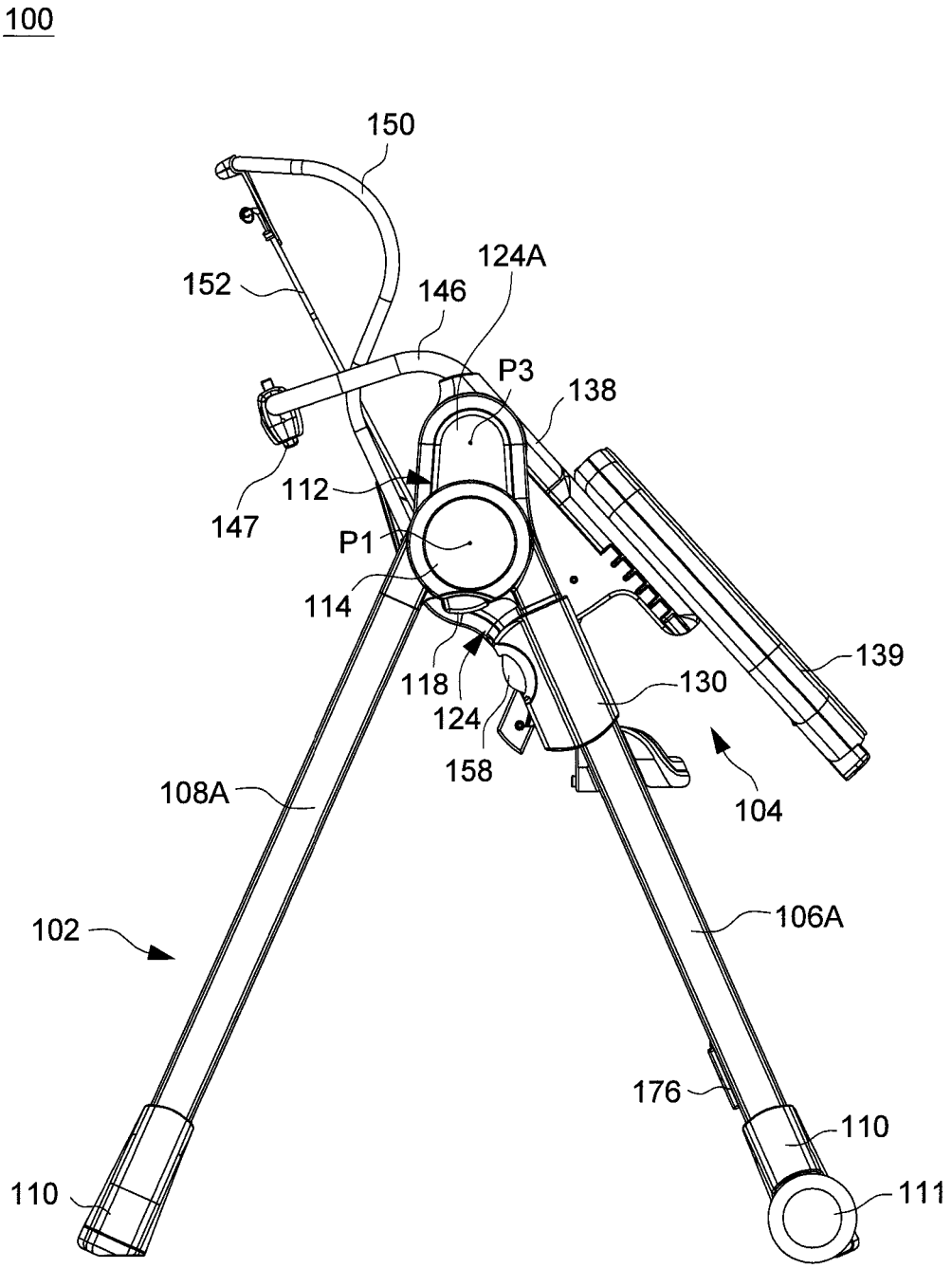
FIG. 18 is a schematic view illustrating an intermediate stage in a folding procedure of the infant high chair where the side segment is rotated toward a folded state while the standing frame is in an unfolded configuration.

Referring to FIG. 18, for collapsing the infant high chair 100, a caregiver can depress the release button 147 on the handle bar 146 to unlock the side segments 138, and then rotate the handle bar 146 and the side segments 138 downward about the pivot axis P3 from the deployed state to a folded state. As described previously, this downward rotation of the side segments 138 drives the front seat portion 128 to slide rearward under the rear seat portion 126, and also causes unlocking of each latch 155 via the coupling of the linkage 162 at each of the left and right side of the seat assembly 104. When they are fully folded, the side segments 138 can lie substantially parallel to the leg segments 106A, and the seat assembly 104 is unlocked.

Figure 19:
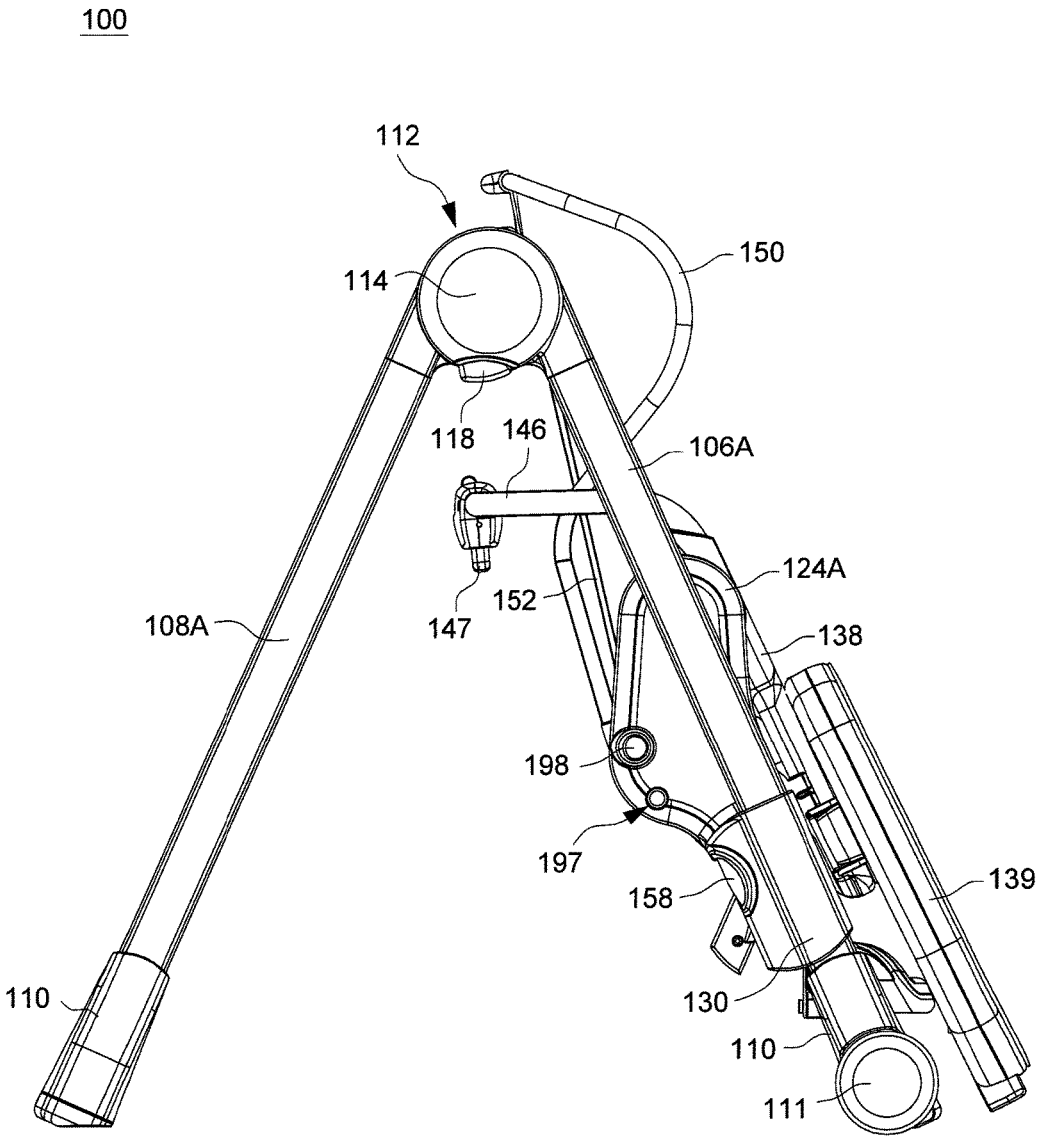
FIG. 19 is a schematic view illustrating another intermediate stage in the folding procedure where the seat assembly with the side segment in the folded state is displaced to a lower position near a foot of the standing frame.

Next referring to FIG. 19, while the standing frame 102 remains locked in the unfolded configuration, the seat assembly 104 with the side segments 138 in the folded state then can slide downward in unison to a predetermined lower position near the feet 110 of the leg segments 106A. Like previously described, the seat assembly 104 when reaching the lower position can push against the release actuators 172 at the left and right side of the seat assembly 104 to cause an unlocking displacement of the latching parts 118, thereby unlocking the standing frame 102. Moreover, the tab 176 can push the lever 170 in rotation, which in turn urges the rocker 168 to disengage from the ramped surface 158A of the release actuating portion 158, thereby resetting the locking function of the latch 155. Accordingly, the spring 156 can bias the latch 155 to contact with an outer surface of the leg segment 106A.

Figure 20:
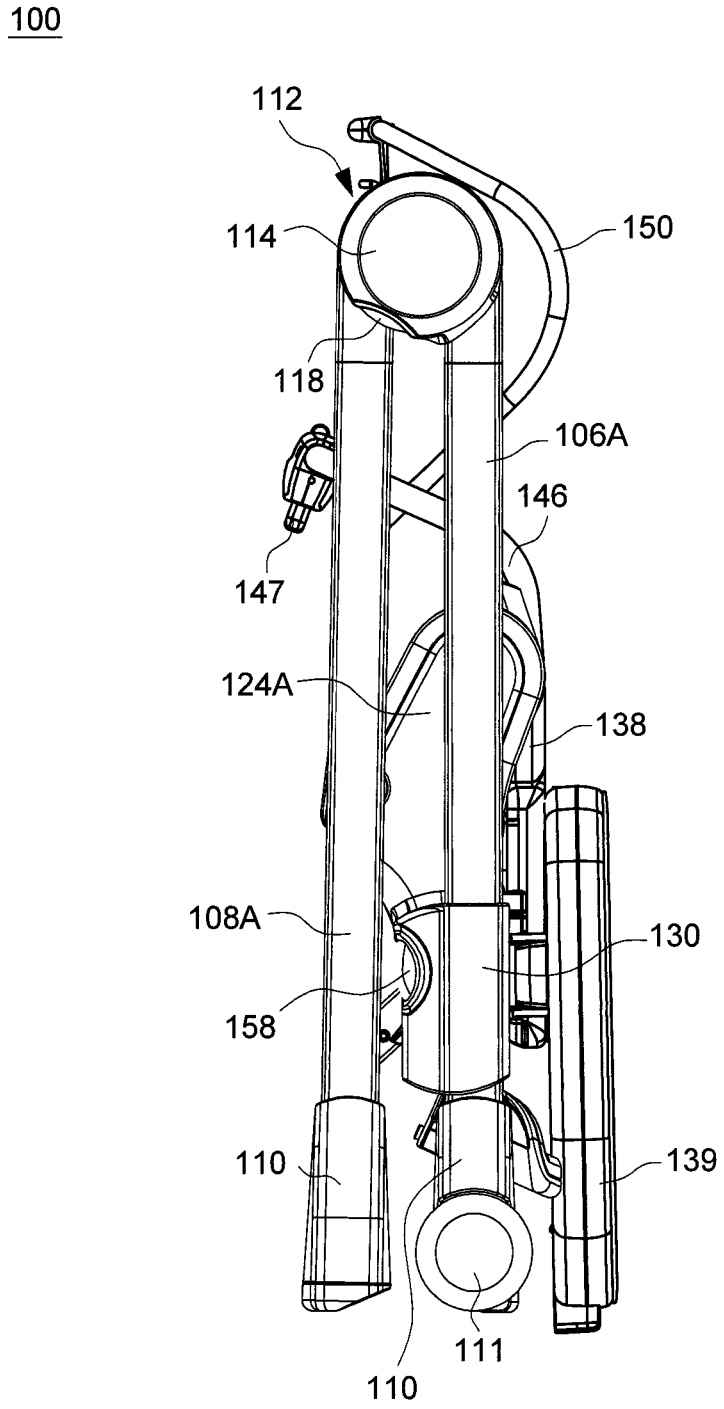
FIG. 20 is a schematic view illustrating the infant high chair in a fully folded state.

Next referring to FIG. 20, while the seat assembly 104 remains in the lower position near the feet 110 of the leg segments 106A, the unlocked standing frame 102 then can be folded by rotating the leg segments 106A and the seat assembly 104 toward the leg segments 108A until the front leg frame 106 and the rear leg frame 108 lie substantially parallel to each other. The infant high chair 100 thereby collapsed can have a compact size with a reduced height and smaller size of the seat assembly 104, which can facilitate its storage. Moreover, the folding procedure of the infant high chair 100 is simple, requiring only one manual unlocking step, i.e., pushing on the release button 147 for unlocking the side segments 138.

The aforementioned procedure can be performed in a reverse order to unfold the infant high chair 100 for use. First, the standing frame 102 is unfolded. While the standing frame 102 is in the unfolded configuration, the seat assembly 104 with the side segments 138 kept in the folded state then is raised from the lower position near the feet 110 to a desirable height. As the seat assembly 104 moves upward away from the release actuators 172, the spring 120 in each hinge structure 112 can urge the latching part 118 to move to an engaged position locking the standing frame 102 in its unfolded configuration. Once the seat assembly 104 has reached a desirable height, the latch 155 can engage with the corresponding opening 160 on the leg segment 106A. The side segments 138 then can be rotated from the folded state to the deployed state to open the seat assembly 104. The rotation of the side segments 138 to the deployed state can drive the linkages 162 to move downward to their downward positions, which bring the protrusions 168A to their initial positions below the ramped surfaces 158A of the release actuating portions 158.

Figure 21:
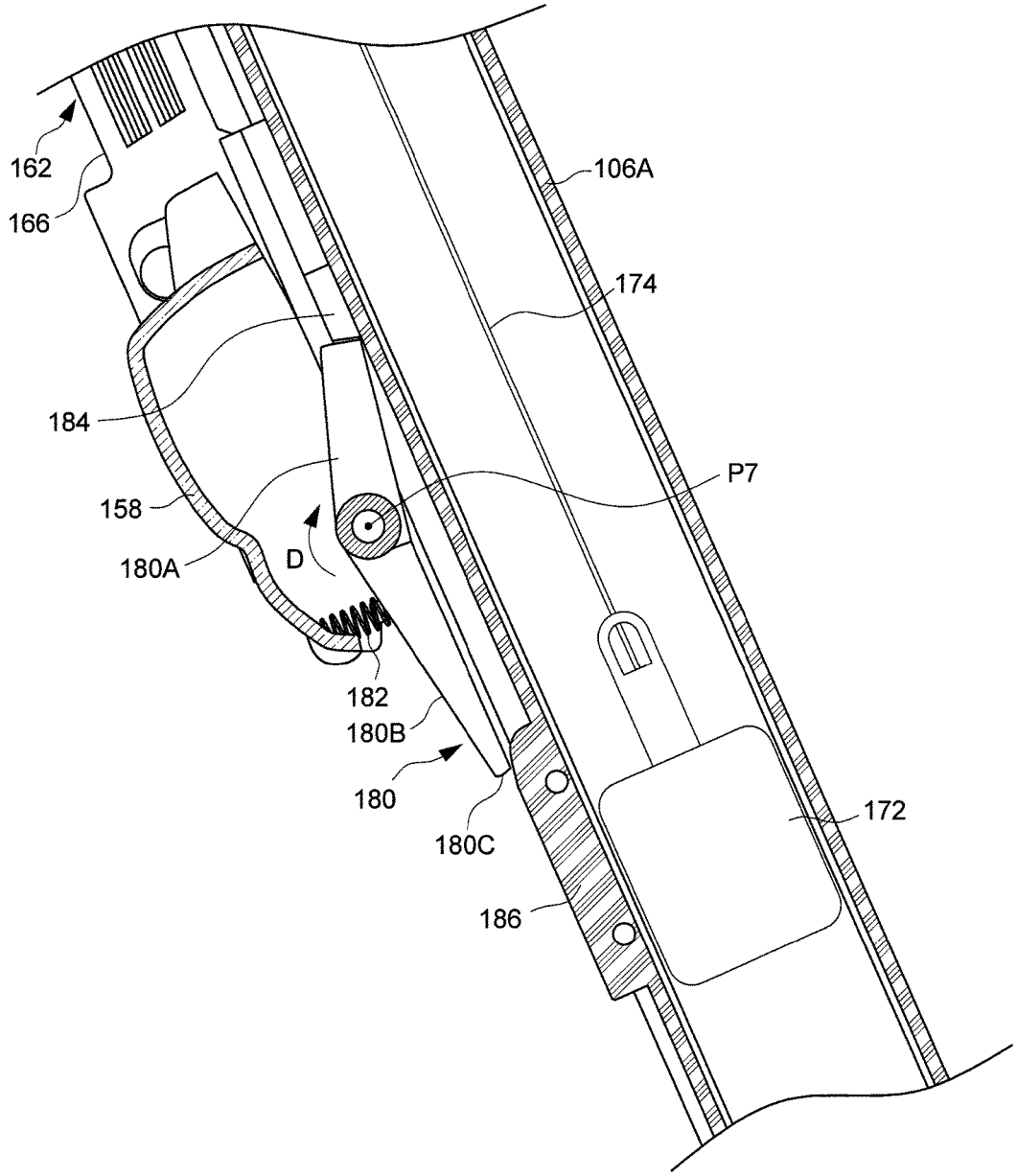
FIGS. 21 and 22 are schematic views illustrating a safety mechanism provided in the infant high chair for preventing a configuration in which the side segments are in the deployed state and the seat assembly is in a lower position that triggers unlocking of the standing frame.
Figure 22:
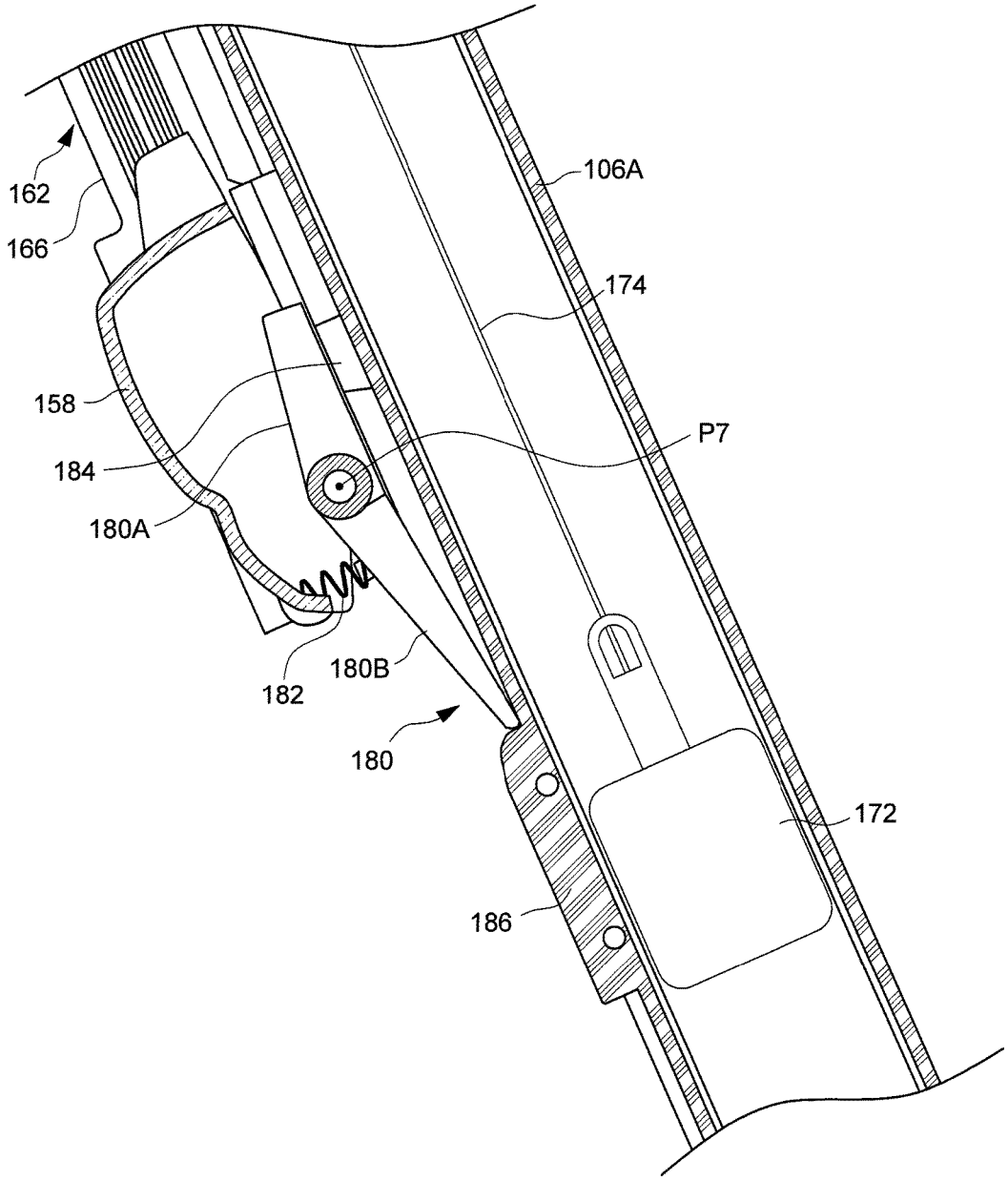

For a safer use of the infant high chair 100, the placement of the side segments 138 in the deployed state should not be allowed while the seat assembly 104 is in the lower or trigger position (as shown in FIG. 19) which corresponds to an unlocking state of the standing frame 102. Otherwise, a child may sit on the opened seat assembly 104 while the standing frame 102 is unlocked. In conjunction with FIGS. 1-9, FIGS. 21 and 22 are schematic views illustrating a safety mechanism provided on the seat assembly 104 that is operable to prevent a configuration in which the side segments 138 are in the deployed state and the seat assembly 104 is in the trigger or lower position. Referring to FIGS. 9, 21 and 22, this safety mechanism can include an impeding part 180 pivotally connected with the seat support frame 124, a spring 182 connected with the impeding part 180, a protrusion 184 affixed with the linkage 162, and a stop abutment 186 affixed with the leg segment 106A of the standing frame 102.

The impeding part 180 is pivotally connected with the seat support frame 124 about a pivot axis P7, and has an upper and a lower portion 180A and 180B located at two opposite sides of the pivot axis P7. The pivot axis P7 can extend generally transversally from a left to a right side of the infant high chair 100 and parallel to the pivot axis P4 of the latch 155. For a more compact assembly, the impeding part 180 may be arranged adjacent to the latch 155 and the release actuating portion 158. As it is connected with the seat support frame 124, the impeding part 180 can move up and down along with the seat assembly 104. Moreover, the impeding part 180 is rotatable about the pivot axis P7 between two positions corresponding to a blocking state (shown in FIG. 22) and a release state (shown in FIG. 21), the blocking state being adapted to stop the seat assembly 104 before it reaches the lower position triggering unlocking of the standing frame 102, and the release state allowing displacement of the seat assembly 104 to the lower position. The spring 182 is configured to bias the impeding part 180 toward the blocking state, and may be respectively connected with the impeding part 180 and an inner sidewall of the release actuating portion 158.

The protrusion 184 is affixed with the linkage 162 (e.g., with the beam 166) near a lower end thereof, and can move up and down with the linkage 162 driven by the rotation of the side segment 138. More specifically, when the side segment 138 is in the deployed state, the protrusion 184 is in an obstructing position lying adjacent to a side of the upper portion 180A (as shown in FIG. 22), which prevents rotation of the impeding part 180 from the blocking state to the release state in a direction that displaces the lower portion 180B away from the leg segment 106A. The impeding part 180 is thereby restricted to remain in the blocking state. When the side segment 138 is in the folded state, the linkage 162 is displaced to its upward position, which brings the protrusion 184 to a clearing position above the upper portion 180A of the impeding part 180 (as shown in FIG. 21), thereby allowing rotation of the impeding part 180 from the blocking state to the release state for displacing the lower portion 180B away from the leg segment 106A.

The stop abutment 186 is affixed with the leg segment 106A near the foot 110, and is placed at a fixed position on the travel path of the impeding part 180 along the leg segment 106A. As better shown in FIG. 3, the stop abutment 186 may be located adjacent to the tab 176.

In FIG. 21, the protrusion 184 is shown in the clearing position, which corresponds to the folded state of the side segment 138. As the seat assembly 104 moves downward and approaches the release actuator 172, the lower portion 180B of the impeding part 180 can come in contact against the stop abutment 186. Because the protrusion 184 is in the clearing position, the impeding part 180 can be pushed by the stop abutment 186 (e.g., by the contact of the stop abutment 186 against a ramped end surface 180C of the impeding part 180) to rotate in the direction D from the blocking state to the release state, which allows passage of the lower portion 180B of the impeding part 180 past the stop abutment 186 and further downward movement of the seat assembly 104 to the lower position to trigger unlocking of the latching part 118 by pushing against the release actuator 172.

While the seat assembly 104 lies in the lower position, the impeding part 180 remains in the release state, and the upper portion 180A of the impeding part 180 abuts an underside of the protrusion 184 in the clearing position, which can block downward displacement of the linkage 162, and consequently block rotation of the side segment 138 from the folded state to the deployed state. Accordingly, rotation of the side segment 138 from the folded state to the deployed state for opening the seat assembly 104 can be prevented while the seat assembly 104 is placed in the lower position and the standing frame 102 is unlocked.

In FIG. 22, the protrusion 184 is shown in the obstructing position, which corresponds to the deployed state of the side segment 138. As the seat assembly 104 moves downward and approaches the release actuator 172 with the protrusion 184 in the obstructing position, the lower portion 180B of the impeding part 180 can come in contact against the stop abutment 186. However, owing to the obstructing position of the protrusion 184 against the upper portion 180A, the impeding part 180 cannot rotate in the direction D from the blocking state to the release state as illustrated in FIG. 21. As a result, the impeding part 180 is restricted by the protrusion 184 to remain in the blocking state in contact against the stop abutment 186, which can bear the weight of the seat assembly 104 stopped at a position above the lower position. Accordingly, the seat assembly 104 applies no push action on the release actuator 172, and the standing frame 102 can remain locked by the latching part 118.

When the seat assembly 104 is moved upward away from the lower position near the foot 110 (which occurs, for example, when the infant high chair 100 is unfolded for use), the spring 182 can bias the impeding part 180 to recover its blocking state leaving a clearance at a side of the upper portion 180A for passage of the protrusion 184. Accordingly, once the seat assembly 104 is positioned at a desirable height, the impeding part 180 does not hinder the deployment of the side segment 138, which can rotate to its deployed state and drive downward displacement of the linkage 162 for bringing the protrusion 184 to its obstructing position as described previously.

The aforementioned safety mechanism can ensure that the seat assembly 104 is not opened while the standing frame 102 is unlocked, and that the seat assembly 104 cannot be lowered to the trigger position unless the side segments 138 are in the folded state. Accordingly, the infant high chair 100 can be safer in use.

Figure 23:
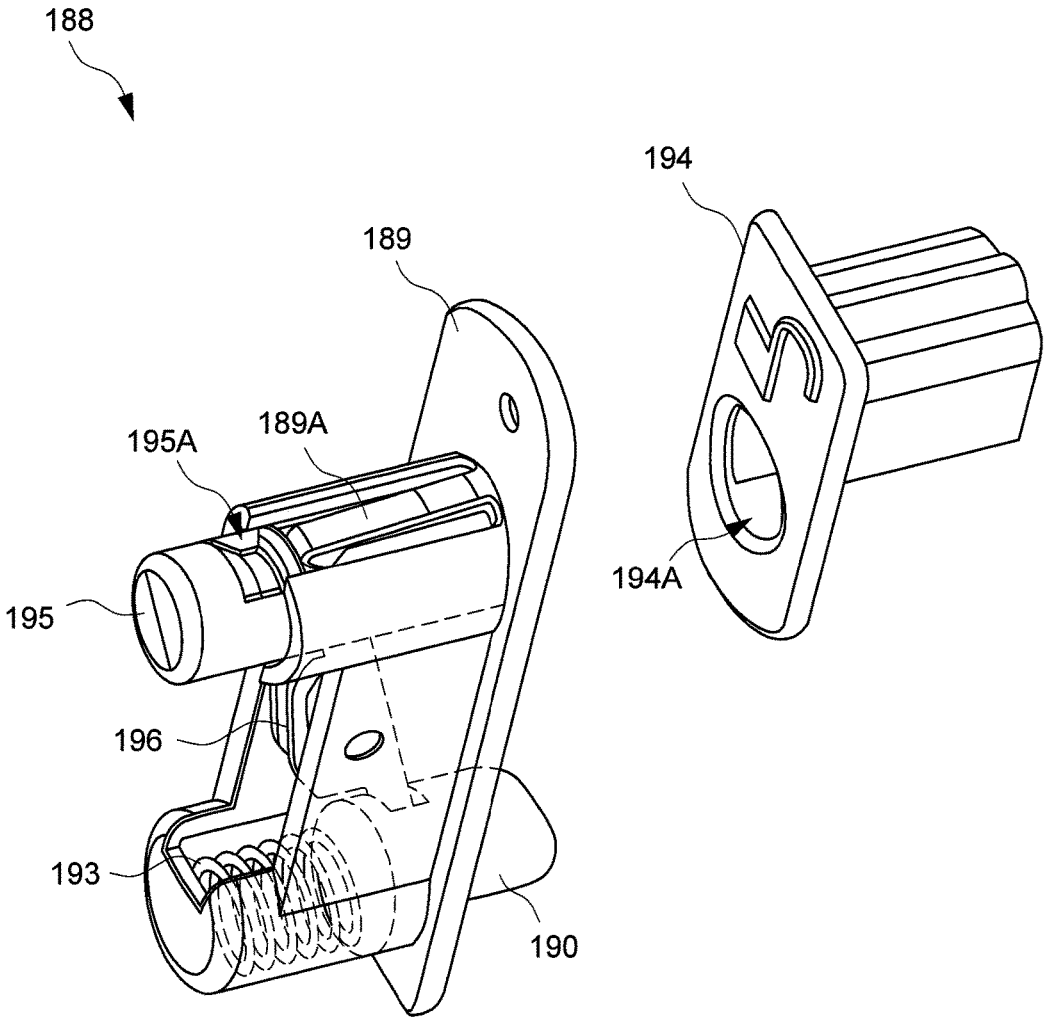
FIG. 23 is a schematic view illustrating the construction of a storage latch device provided in the infant high chair.

In conjunction with FIG. 2, FIG. 23 is a schematic view illustrating a storage latch device 188 operable to lock the standing frame 102 in a folded configuration. The storage latch device 188 can be assembled with one leg segment 108A, and include a casing 189, a latching member 190, a spring 193, a release button 195 and a lever 196. The casing 189 is affixed with the leg segment 108A, and includes two cavities in which are respectively arranged the latching member 190 and the release button 195.

The latching member 190 is slidably assembled with the casing 189, and can project toward an inner side of the leg segment 108A facing the region where is placed the seat assembly 104. The spring 193 has two opposite ends respectively connected with the latching member 190 and an inner sidewall of the casing 189, and bias the latching member 190 toward a locking state for engaging with the seat assembly 104.

The release button 195 is slidably assembled with the casing 189, and can protrude outward at two opposite sides of the leg segment 108A, i.e., the inner side of the leg segment 108A facing the region where is placed the seat assembly 104, and the outer side of the leg segment 108A. The release button 195 may have a generally cylindrical surface formed with an indentation 195A. The casing 189 can have a resilient prong 189A operable to engage and disengage the indentation 195A.

The lever 196 is pivotally connected with the casing 186, and has two opposite ends respectively connected with the latching member 190 and the release button 195. Through the connection of the lever 196, the latching member 190 and the release button 195 are coupled with each other and can slide in opposite directions. An outer panel 194 facing on the outer side of the leg segment 108A can be affixed with the casing 189, and can have an opening 194A through which the release button 195 can extend outward.

Referring to FIGS. 2, 3, 20 and 23, when the standing frame 102 is fully folded, the latching member 190 can be biased by the spring 193 to engage with an opening 197 provided on an outer surface of one lateral portion 124A of the seat support frame 124. The standing frame 102 can be thereby locked in the collapse state. While the latching member 190 is in the locked state, the resilient prong 189A is disengaged from the indentation 195A of the release button 195.

For unfolding the standing frame 102, the release button 195 can be depressed inward, which causes the latching member 190 to disengage from the opening 197 and the resilient prong 189A to engage with the indentation 195A. The engagement of the resilient prong 189A with the indentation 195A can keep the release button 195 in the depressed position and the latching member 190 in the unlocked state, so that the caregiver does not need to continuously press the release button 195 for unlocking the storage latch device 188. While the release button 195 is in the depressed position, an end thereof protrudes outward at the inner side of the leg segment 108A. As the standing frame 102 is unfolded, the end of the release button 195 protruding on the inner side of the leg segment 108A can contact with a raised portion 198 on the outer surface of the lateral portion 124A, which pushes the release button 195 to slide toward the outer side of the leg segment 108A and causes the latching member 190 to slide in a direction opposite to that of the release button 195. Accordingly, the storage latch device 188 can switch from the unlocked state to the initial state enabling locking engagement of the latching member 190.

Figure 24:
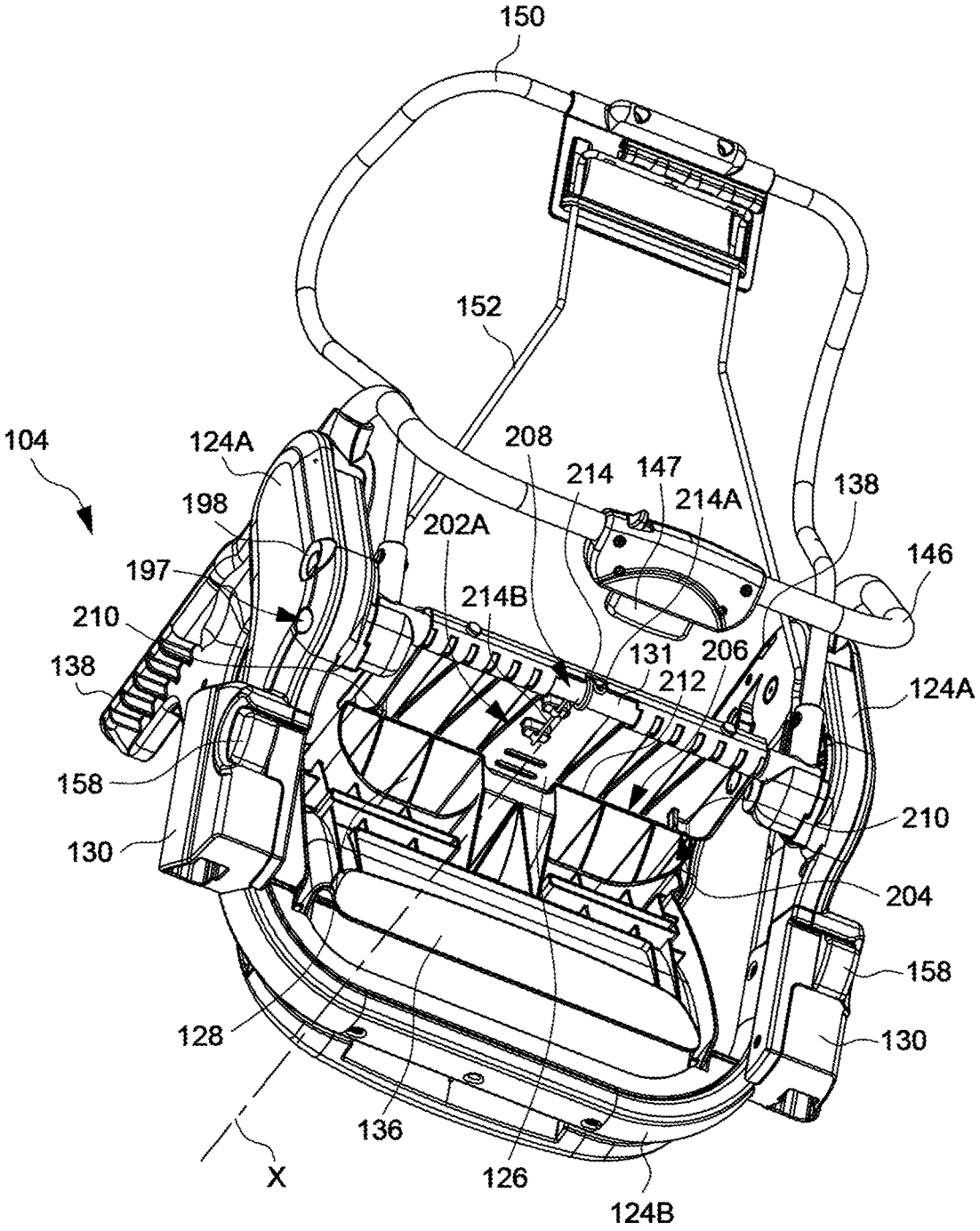
FIG. 24 is a schematic view illustrating a seat assembly of the infant high chair including a weight-sensitive lock mechanism.
Figure 25:
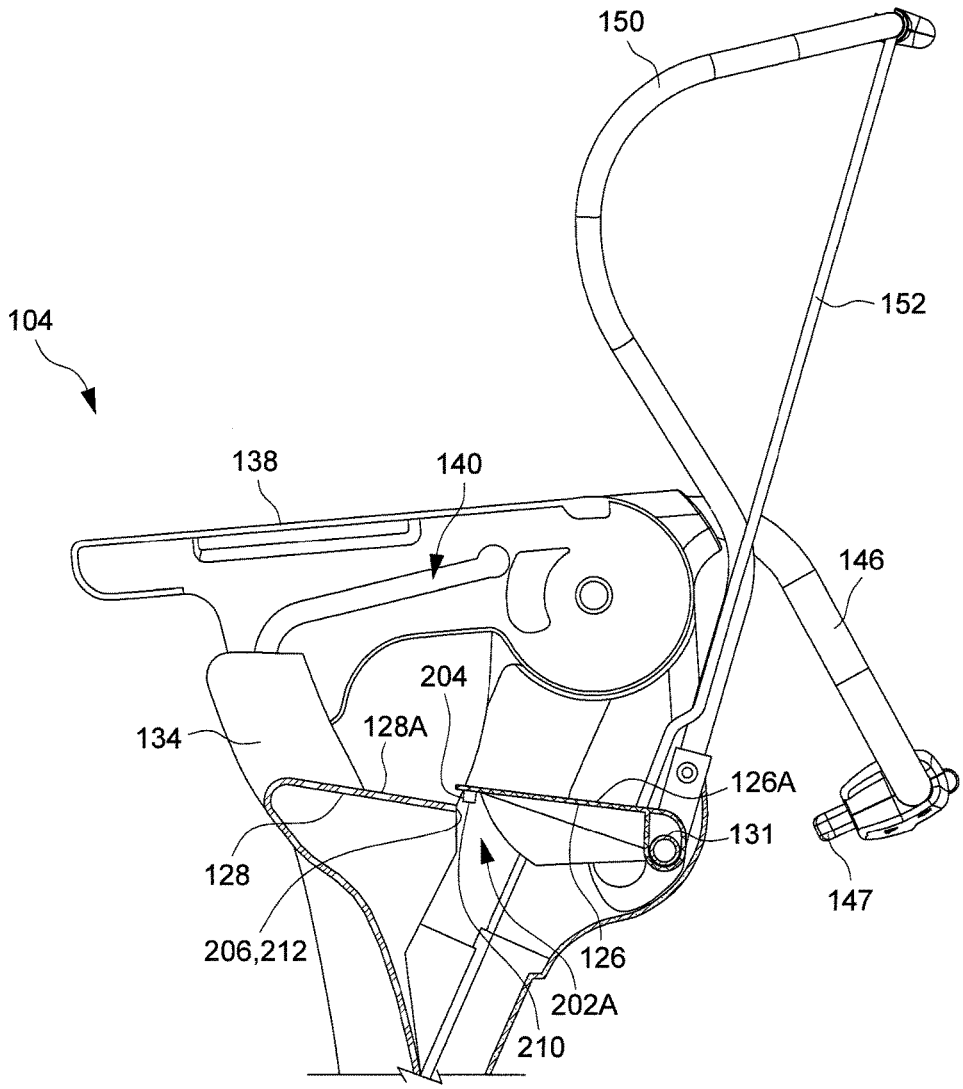
FIG. 25 is a schematic view illustrating the weight-sensitive lock mechanism shown in FIG. 24 in a first state with no load placed on the seat assembly.
Figure 26:
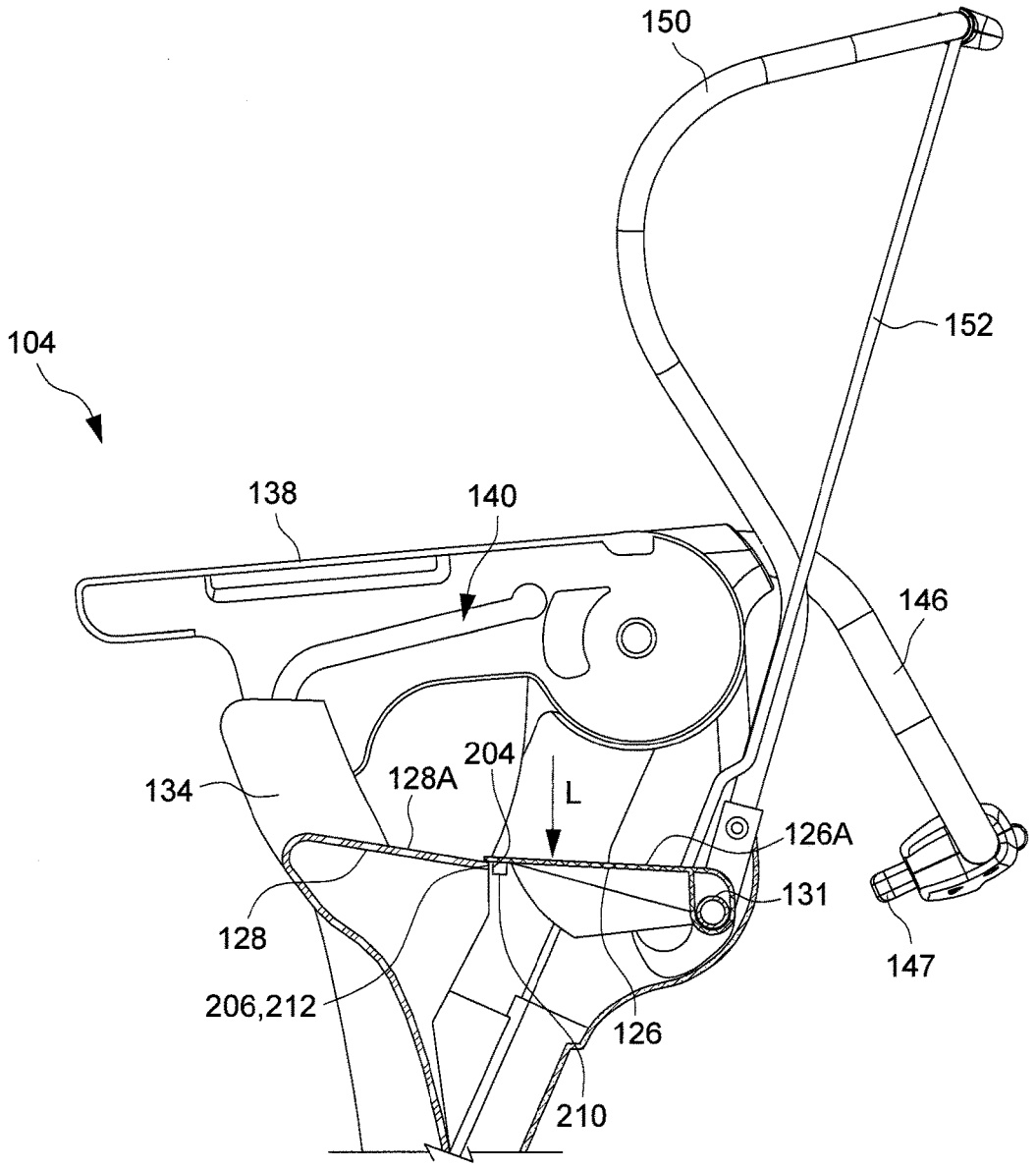
FIG. 26 is a schematic view illustrating the weight-sensitive lock mechanism shown in FIG. 24 in a second state with a load placed on the seat assembly.

As described previously, the infant high chair 100 has a front seat portion 128 that can be movable relative to the rear seat portion 126 between a contracted state and an expanded state. In some embodiments, the infant high chair 100 can further include a safety mechanism to prevent accidental of the front seat portion 128 toward the rear seat portion 126. FIGS. 24-26 are schematic views illustrating an embodiment of such safety mechanism implemented as a weight-sensitive lock mechanism 202A provided in the seat assembly 104 adjacent to the rear and front seat portions 126 and 128. Referring to FIGS. 24-26, the weight-sensitive lock mechanism 202A can be activated by the placement of a load L on the seat assembly 104 (e.g., when a child sits on the rear and front seat portions 126 and 128) to prevent displacement of the front seat portion 128 relative to the rear seat portion 126 from the expanded state to the contracted state. The weight-sensitive lock mechanism 202A can include a first contact surface 204 affixed with the rear seat portion 126, a second contact surface 206 affixed with the front seat portion 128, and a resilient member 208 connected with the seat assembly 104.

The first contact surface 204 can be defined on a stop rib 210 that protrudes downward at an underside of the rear seat portion 126. The first contact surface 204 can be located near a front of the rear seat portion 126 and face forward. The second contact surface 206 can be defined by the rear edge 212 of the front seat portion 128, and can be oriented rearward. As shown in FIG. 24, the rear seat portion 126 can be connected with a shaft portion 131 having two ends assembled with the seat support frame 124, and some degrees of rotation of the rear seat portion 126 about the shaft portion 131 can be allowed. The first and second contact surfaces 204 and 206 can move toward or away from each other as the rear seat portion 126 rotates downward or upward about the shaft portion 131 relative to the front seat portion 128.

The resilient member 208 can be connected with the seat assembly 104, and is configured to apply a biasing force for displacing the first and second contact surfaces 204 and 206 away from each other, i.e., for increasing a distance between the first and second contact surfaces 204 and 206. In one embodiment, the resilient member 208 can be a torsion spring 214 that is arranged around the shaft portion 131 and is connected with the rear seat portion 126. For example, the torsion spring 214 can have a first end 214A connected with the shaft portion 131, and a second end 214B connected with the rear seat portion 126 at a location offset from the shaft portion 131. The resilient member 208 can thereby apply a spring force that biases the rear seat portion 126 to rotate upward about the shaft portion 131 for displacing the first contact surface 204 of the rear seat portion 126 away from the second contact surface 206 of the front seat portion 128, i.e., for increasing a distance between the first contact surface 204 and the second contact surface 206.

In conjunction with FIG. 24, FIGS. 25 and 26 are schematic cross-sectional views illustrating exemplary operation of the weight-sensitive lock mechanism 202A. When no load is placed on the sitting surface defined by the upper surfaces 126A and 128A of the rear and front seat portions 126 and 128 (i.e., no child sits on the seat assembly 104), the biasing force applied by the resilient member 208 urges the rear seat portion 126 upward relative to the front seat portion 128, which displaces the first contact surface 204 of the rear seat portion 126 away from the second contact surface 206 of the front seat portion 128. This configuration where the first and second contact surfaces 204 and 206 are spaced apart from each other by an increased distance is schematically shown in FIG. 25. Like described previously, in case the infant high chair 100 is to be collapsed, the side segments 138 can be rotated downward, which can drive the front seat portion 128 to slide rearward toward the underside of the rear seat portion 126. As the front seat portion 128 slides rearward relative to the rear seat portion 126, the second contact surface 206 can travel past the first contact surface 204. Accordingly, the weight-sensitive lock mechanism 202A allows the front seat portion 128 to slide relative to the rear seat portion 126 between the contacted and expanded state when no child sits on the seat assembly 104.

Referring to FIG. 26, while the rear and front seat portions 126 and 128 are in the expanded state, the placement of a load L (corresponding to a child sitting on the seat assembly 104) on the sitting surface defined by the upper surfaces 126A and 128A of the rear and front seat portions 126 and 128 (in particular on the region corresponding to the upper surface 126A of the rear seat portion 126) urges the rear seat portion 126 to rotationally move relative to the front seat portion 128 in a downward direction against the spring force of the resilient member 208. As a result, a front end region of the rear seat portion 126 can contact against the upper surface 128A of the front seat portion 128 at a rear end region thereof, and the first contact surface 204 of the rear seat portion 126 can be displaced toward the second contact surface 206 of the front seat portion 128, which reduces the distance between the first and second contact surfaces 204 and 206. As shown in FIG. 26, the first contact surface 204 can thus lie adjacent to the second contact surface 206, and the engaging contact between the first and second contact surfaces 204 and 206 can prevent sliding of the front seat portion 128 relative to the rear seat portion 126 from the expanded state to the contracted state. Accordingly, accidental collapse of the seat assembly 104 (e.g., owing to an inadvertent pressure applied on the side segments 138 not properly locked) can be prevented.

Figure 27:
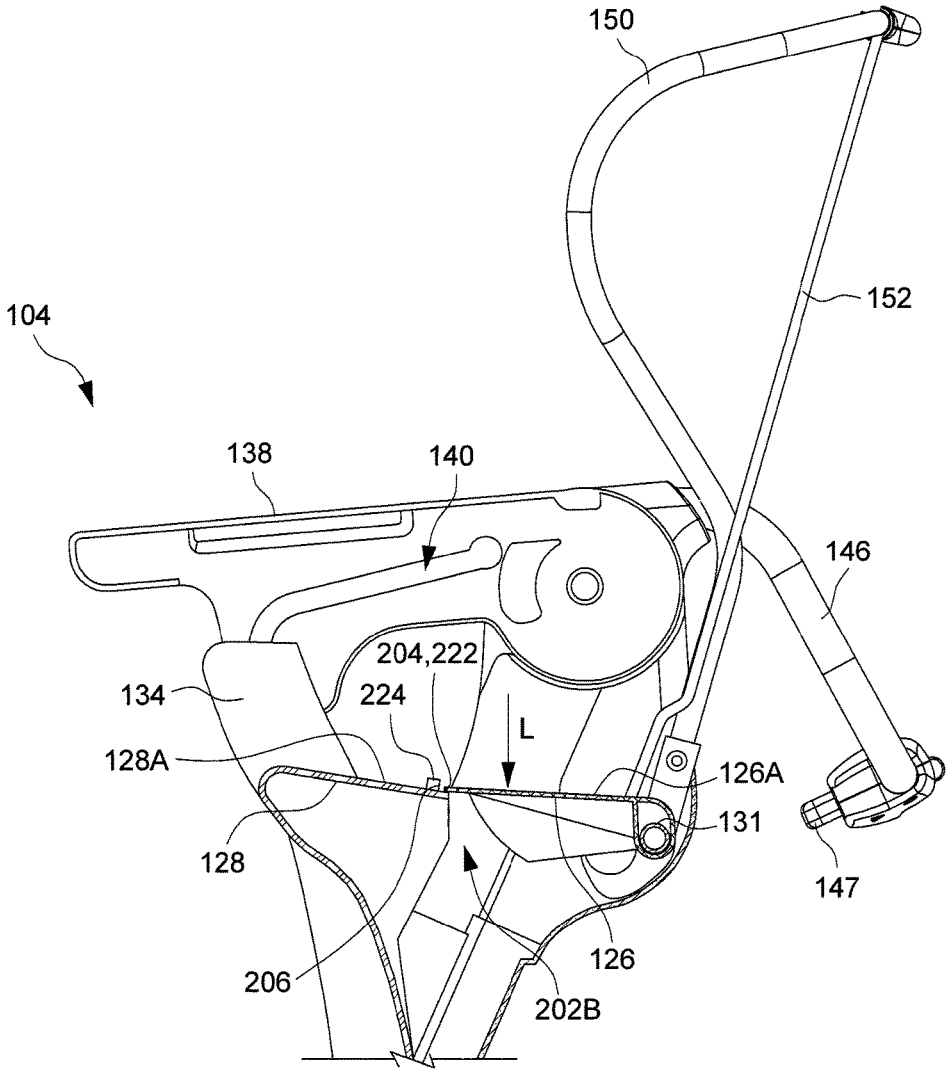
FIG. 27 is a schematic view illustrating a variant embodiment of the weight-sensitive lock mechanism shown in FIG. 24.

FIG. 27 is a schematic view illustrating a variant embodiment of a weight-sensitive lock mechanism 202B. Like previously described, the weight-sensitive lock mechanism 202B can include the first contact surface 204 affixed with the rear seat portion 126, the second contact surface 206 affixed with the front seat portion 128, and the resilient member 208 (as shown in FIG. 24) operable to bias the rear seat portion 126 upward relative to the front seat portion 128. However, the first contact surface 204 can be defined by a front edge 222 of the rear seat portion 126 that faces forward, whereas the second contact surface 206 can be defined on a stop rib 224 that protrudes upward from the upper surface 128A of the front seat portion 128. The operation of the weight-sensitive lock mechanism 202B is similar to the weight-sensitive lock mechanism 202A described previously, and can be activated by the placement of a load L on the seat assembly 104.

Figure 28:
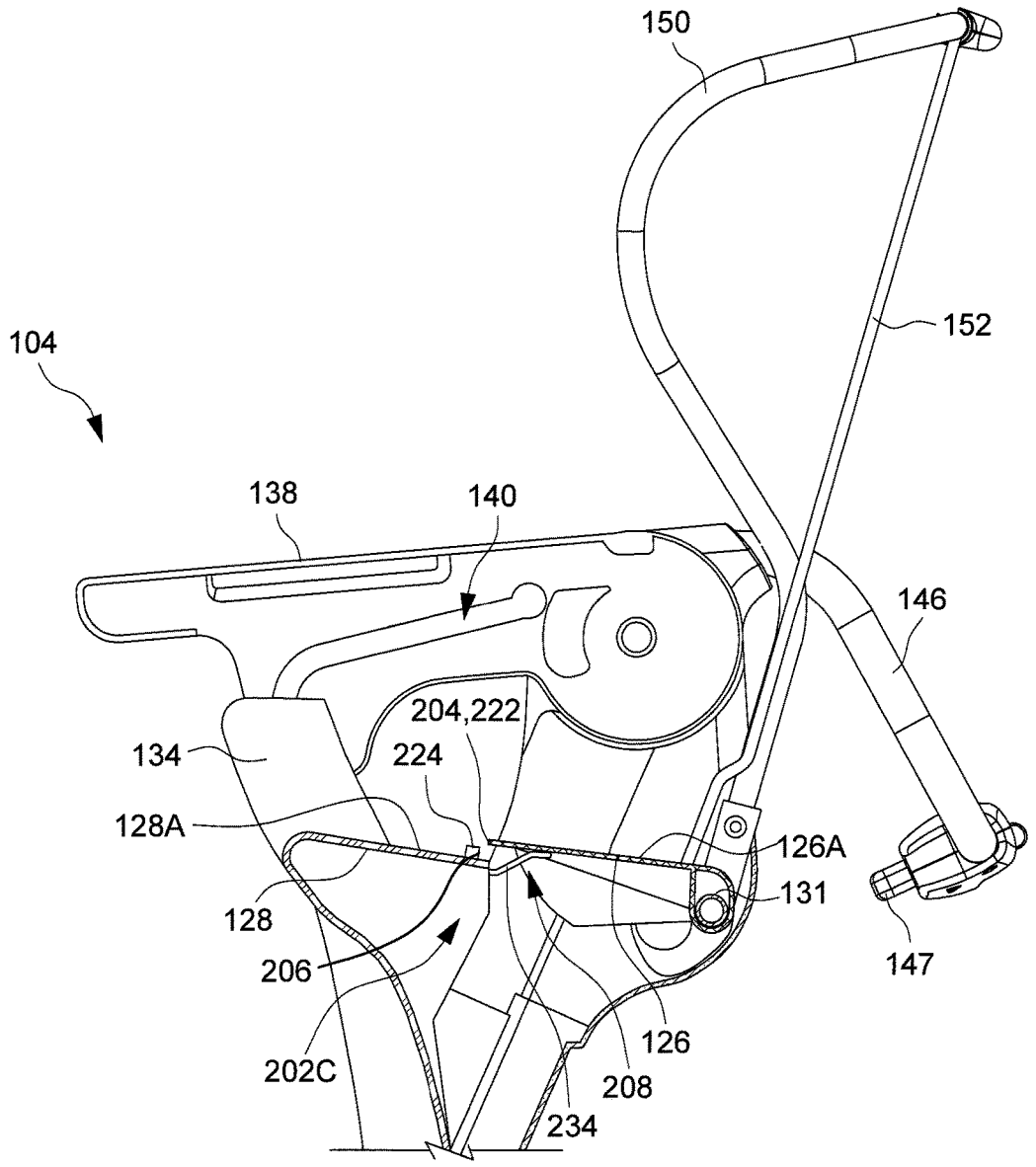
FIGS. 28-30 are schematic views illustrating other variant embodiments of a weight-sensitive lock mechanism provided in the seat assembly.
Figure 29:
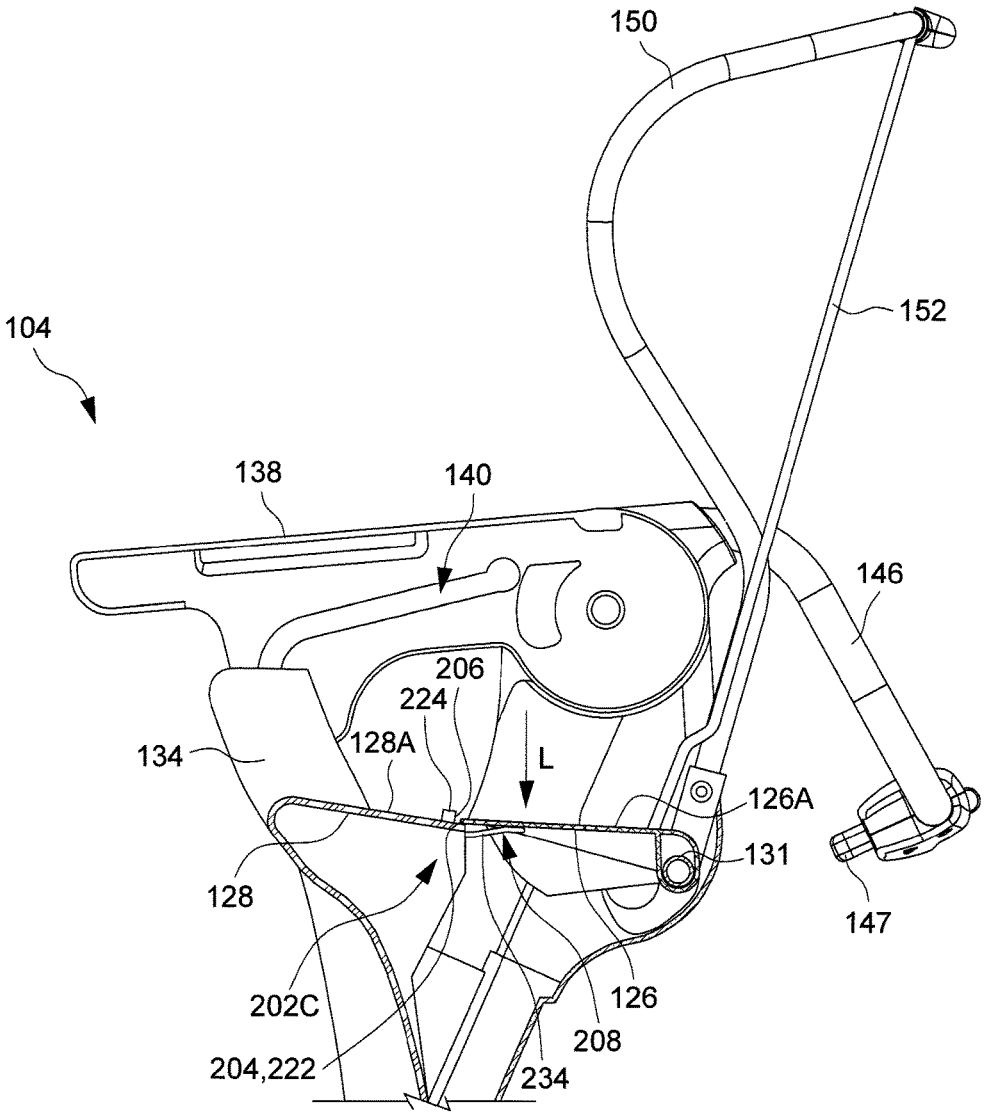

FIGS. 28 and 29 are schematic views illustrating another embodiment of a weight-sensitive lock mechanism 202C. Like previously described, the weight-sensitive lock mechanism 202C can include the first contact surface 204 affixed with the rear seat portion 126, the second contact surface 206 affixed with the front seat portion 128, and the resilient member 208 operable to bias the rear seat portion 126 upward relative to the front seat portion 128. However, the resilient member 208 is affixed with the front seat portion 128 near a rear thereof, and can be formed as an elastically deformable rib 234 extendible above the upper surface 128A and rearward from the rear edge 212 of the front seat portion 128. Moreover, the first contact surface 204 can be defined by the front edge 222 of the rear seat portion 126 that is oriented forward, and the second contact surface 206 can be defined on the stop rib 224 that protrudes upward from the upper surface 128A of the front seat portion 128. The operation of the weight-sensitive lock mechanism 202C is similar to the weight-sensitive lock mechanism 202A or 202B described previously. As shown in FIG. 28, when no load is placed on the seat assembly 104, the elastically deformable rib 234 can project above the upper surface 128A of the front seat portion 128 to push the front region of the rear seat portion 126 upward, which increases the distance between the first and second contact surfaces 204 and 206. Referring to FIG. 29, when a load L corresponding to a child is placed on the sitting surface defined by the upper surfaces 126A and 128A of the rear and front seat portions 126 and 128 (in particular on the region corresponding to the upper surface 126A of the rear seat portion 126), the rear seat portion 126 is urged downward relative to the front seat portion 128, which causes deflection of the elastically deformable rib 234. As a result, a front end region of the rear seat portion 126 can contact against the upper surface 128A of the front seat portion 128 at a rear end region thereof, and the first contact surface 204 of the rear seat portion 126 can be displaced toward the second contact surface 206 of the front seat portion 128, which reduces the distance between the first and second contact surfaces 204 and 206.

Figure 30:
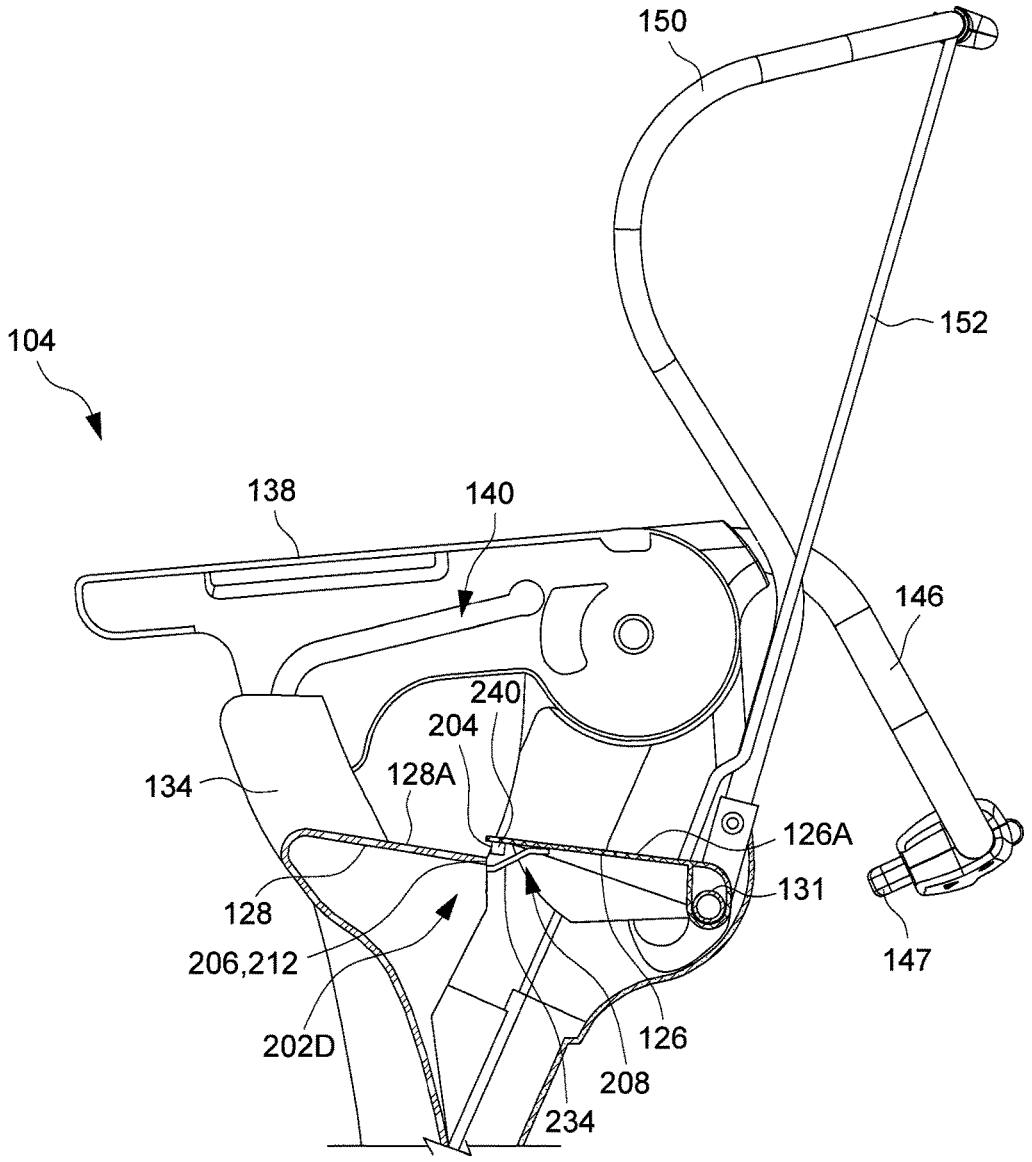

FIG. 30 is a schematic view illustrating another embodiment of a weight-sensitive lock mechanism 202D. The weight-sensitive lock mechanism 202D is similar to the embodiment shown in FIGS. 28 and 29, except that the first contact surface 204 can be defined on a stop rib 240 that protrudes downward at an underside of the rear seat portion 126, and the second contact surface 206 can be defined by the rear edge 212 of the front seat portion 128. The operation of the weight-sensitive lock mechanism 202D can be similar to the embodiments described previously.

The aforementioned weight-sensitive lock mechanisms have been described with reference to embodiments where the front seat portion 128 slides toward the underside of the rear seat portion 126 to switch from the expanded state to the contracted state. However, one will appreciate that similar weight-sensitive lock mechanisms may be implemented in other embodiments where the front seat portion 128 slides onto the rear seat portion 126 to contract the seat assembly 104. In such embodiments, the first contact surface of the rear seat portion 126 and the second contact surface of the front seat portion 128 can be respectively defined as the front edge of the rear seat portion 126 and a stop rib protruding downward from the front seat portion 128, or the first contact surface of the rear seat portion 126 and the second contact surface of the front seat portion 128 can be respectively defined as a stop rib protruding upward from the upper surface of the rear seat portion 126 and the rear edge of the front seat portion 128. In those embodiments, while the rear and front seat portions 126 and 128 are in the expanded state, the placement of a load L on the sitting surface defined by the rear and front seat portions 126 and 128 (in particular on the upper surface 128A of the front seat portion 128) urges the front seat portion 128 to rotationally move relative to the rear seat portion 126 in a downward direction, which causes a rear end region of the front seat portion 128 to contact against the upper surface of the rear seat portion 126 at a front end region thereof, and the second contact surface of the front seat portion 128 can be displaced toward the first contact surface of the rear seat portion 126. The engagement of the two contact surfaces can thereby block sliding displacement of the front seat portion 128 onto the rear seat portion 126.

One will appreciate that other than the infant high chair embodiment, the constructions and operations of the seat assembly 104 and weight-sensitive lock mechanisms 202A, 202B, 202C and 202D described herein may be suitable for other types of infant chairs.

Advantages of the structures described herein include the ability to provide an infant high chair that can collapse into a more compact size for facilitating storage. The collapsed infant high chair has a reduced height, and the seat assembly can be arranged to occupy a smaller volume. Moreover, the seat assembly implemented in the infant high chair can include a weight-sensitive lock mechanism that prevents accidental collapse of the seat assembly, which can make it safer in use.

Realizations of the infant high chair and seat assembly have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant high chair comprising:

a collapsible standing frame;

a seat support frame connected with the standing frame;

a rear and a front seat portion respectively connected with the seat support frame, the front seat portion being movable relative to the rear seat portion between an expanded state and a contracted state, the front and rear seat portion when in the expanded state defining a sitting surface adapted to receive a child; and a weight-sensitive lock mechanism placed adjacent to the rear and front seat portions, the weight-sensitive lock mechanism being activated by the placement of a load on the sitting surface to prevent displacement of the front seat portion relative to the rear seat portion from the expanded state to the contracted state, wherein the weight-sensitive lock mechanism includes a first contact surface affixed with the rear seat portion, and a second contact surface affixed with the front seat portion, the first and second contact surfaces being engagable with each other to block displacement of the front seat portion relative to the rear seat portion from the expanded state to the contracted state, and the rear seat portion and the front seat portion being movable relative to each other to reduce a distance between the first and second contact surfaces in response to the placement of a load on the sitting surface in the expanded state.

2. The infant high chair according to claim 1, wherein the weight-sensitive lock mechanism further includes:

a resilient member applying a force for causing relative movement between the rear seat portion and the front seat portion in a first direction that increases a distance between the first and second contact surfaces;

wherein the placement of a load on the sitting surface causes relative movement between the rear seat portion and the front seat portion in a second direction that reduces a distance between the first and second contact surfaces.

3. The infant high chair according to claim 2, wherein the rear seat portion is connected with a shaft portion that has two ends assembled with the seat support frame.

4. The infant high chair according to claim 3, wherein the resilient member is configured to apply a force that biases the rear seat portion in rotation about the shaft portion.

5. The infant high chair according to claim 4, wherein the resilient member is a torsion spring that is assembled around the shaft portion and is connected with the rear seat portion.

6. The infant high chair according to claim 4, wherein the first contact surface is defined on a stop rib that protrudes downward at an underside of the rear seat portion.

7. The infant high chair according to claim 2, wherein the resilient member is affixed with the front seat portion near a rear thereof, the resilient member being extendible above an upper surface of the front seat portion.

8. The infant high chair according to claim 2, wherein the second contact surface is defined on a stop rib that protrudes upward from an upper surface of the front seat portion.

9. The infant high chair according to claim 1, wherein the front seat portion is slidable relative to the rear seat portion along a lengthwise axis extending from a rear to a front of the infant high chair.

10. The infant high chair according to claim 9, wherein the front seat portion is slidable rearward toward an underside of the rear seat portion.

11. The infant high chair according to claim 1, further including:

a side segment pivotally connected with the seat support frame about a pivot axis, the front seat portion being respectively connected with the seat support frame and the side segment at two vertically spaced-apart locations;

wherein a rotation of the side segment in a folding direction drives a rearward sliding displacement of the front seat portion relative to the rear seat portion.

12. The infant high chair according to claim 11, wherein the front seat portion has an upper surface, and a first and a second extension respectively projecting upward and downward relative to the upper surface, the first extension being connected with the side segment, and the second extension being connected with the seat support frame.

13. The infant high chair according to claim 11, wherein the two locations where the front seat portion respectively connects with the seat support frame and the side segment are arranged forward relative to the pivot axis.

14. A seat assembly for an infant chair, comprising:

a seat support frame;

a rear and a front seat portion respectively connected with the seat support frame, the front seat portion being slidable relative to the rear seat portion along a lengthwise axis between an expanded state and a contracted state, the lengthwise axis extending from a front to a rear of the seat assembly, and the front and rear seat portion when in the expanded state defining a sitting surface adapted to receive a child; and a weight-sensitive lock mechanism placed adjacent to the rear and front seat portions, the weight-sensitive lock mechanism being activated by the placement of a load on the seat assembly to prevent displacement of the front seat portion relative to the rear seat portion from the expanded state to the contracted state.

15. The seat assembly according to claim 14, wherein the weight-sensitive lock mechanism includes:

a first contact surface affixed with the rear seat portion, and a second contact surface affixed with the front seat portion, the first and second contact surfaces engaging with each other to block displacement of the front seat portion relative to the rear seat portion from the expanded state to the contracted state; and a resilient member applying a force for causing relative movement between the rear seat portion and the front seat portion in a first direction that increases a distance between the first and second contact surfaces;

wherein the placement of a load on the sitting surface causes relative movement between the rear seat portion and the front seat portion in a second direction that reduces a distance between the first and second contact surfaces.

16. The seat assembly according to claim 15, wherein the rear seat portion is connected with a shaft portion that has two ends assembled with the seat support frame.

17. The seat assembly according to claim 16, wherein the resilient member is configured to apply a force that biases the rear seat portion in rotation about the shaft portion.

18. The seat assembly according to claim 16, wherein the resilient member is a torsion spring that is assembled around the shaft portion and is connected with the rear seat portion.

19. The seat assembly according to claim 15, wherein the resilient member is affixed with the front seat portion near a rear thereof.

20. The seat assembly according to claim 15, wherein the second contact surface is defined on a stop rib that protrudes upward from an upper surface of the front seat portion.

21. The seat assembly according to claim 15, wherein the first contact surface is defined on a stop rib that protrudes downward at an underside of the rear seat portion.

22. The seat assembly according to claim 14, wherein the front seat portion is slidable rearward toward an underside of the rear seat portion.

23. The seat assembly according to claim 14, wherein the seat assembly further includes:

a side segment pivotally connected with the seat support frame about a pivot axis, the front seat portion being respectively connected with the seat support frame and the side segment at two vertically spaced-apart locations;

wherein a rotation of the side segment in a folding direction drives a rearward sliding displacement of the front seat portion relative to the rear seat portion.

24. The seat assembly according to claim 23, wherein the front seat portion has an upper surface, and a first and a second extension respectively projecting upward and downward relative to the upper surface, the first extension being connected with the side segment, and the second extension being connected with the seat support frame.

* * * * *